US012703056B2

(12) United States Patent
Richardson

(10) Patent No.: US 12,703,056 B2
(45) Date of Patent: Aug. 11, 2026

(54) METHOD AND APPARATUS FOR APPLYING A UNIFORM TEXTURE TO AN AGGREGATE SURFACE

(71) Applicant: VERTICAL CONCRETE POLISHING INC., Whitesburg, GA (US)

(72) Inventor: Mark Jack Richardson, Whitesburg, GA (US)

(73) Assignee: VERTICAL CONCRETE POLISHING INC., Whitesburg, GA (US)

( * ) Notice: Subject to any disclaimer, the term of this patent is extended or adjusted under 35 U.S.C. 154(b) by 1248 days.

(21) Appl. No.: 17/610,234

(22) PCT Filed: Nov. 9, 2020

(86) PCT No.: PCT/US2020/059709
§ 371 (c)(1),
(2) Date: Nov. 10, 2021

(87) PCT Pub. No.: WO2021/092572
PCT Pub. Date: May 14, 2021

(65) Prior Publication Data

US 2022/0241926 A1 Aug. 4, 2022

Related U.S. Application Data

(60) Provisional application No. 62/932,626, filed on Nov. 8, 2019.

(51) Int. Cl.

| | |
|---|---|
| ***B24B 27/00*** | (2006.01) |
| ***B24B 7/18*** | (2006.01) |
| ***B24B 7/22*** | (2006.01) |

(52) U.S. Cl.
CPC ..... *B24B 27/0046* (2013.01); *B24B 7/18* (2013.01); *B24B 7/22* (2013.01)

(58) Field of Classification Search
CPC .. B24B 7/182; B24B 7/18; B24B 7/22; B24B 7/222; B24B 7/224; B24B 27/0046; B24B 41/02
(Continued)

(56) References Cited

U.S. PATENT DOCUMENTS

| | | | |
|---|---|---|---|
| 2,075,369 | A | 3/1937 | Stetler |
| 2,629,210 | A | 2/1953 | Robinson |

(Continued)

FOREIGN PATENT DOCUMENTS

WO WO-2007141320 A1 * 12/2007 ..... B25J 11/0065

OTHER PUBLICATIONS

Machine translation of WO-2007141320-A1 (Year: 2007).*
International Search Report and Written Opinion for WO 2020/092572 (PCT/US2020/059709), dated Mar. 31, 2021, pp. 1-16.

*Primary Examiner* — Robert F Neibaur
(74) *Attorney, Agent, or Firm* — Thomas | Horstemeyer, LLP

(57) ABSTRACT

An apparatus is provided for texturing a work surface comprised of aggregate, that includes: a texturing carriage; a carriage rotation device coupled to the texturing carriage and configured to selectively rotate the texturing carriage; a vertical frame member configured to guide the texturing carriage or the carriage rotation device, or both, in a vertical direction in relation to a surface on which the apparatus rests. Alternately, the apparatus can include: a texturing carriage, the texturing carriage including a texturing head configured to hold one or more texturing pads and a texturing head motor, the texturing head motor configured to move the one or more texturing pads across a work surface, the
(Continued)

texturing carriage configured to extend and retract the texturing head towards and away from the work surface.

25 Claims, 29 Drawing Sheets

(58) Field of Classification Search
USPC ..... 451/5, 41, 353, 354, 280, 340, 342
See application file for complete search history.

(56) References Cited

U.S. PATENT DOCUMENTS

| | | | | |
|---|---|---|---|---|
| 6,189,473 | B1 * | 2/2001 | Appel | B05B 13/005 114/222 |
| 11,958,729 | B2 * | 4/2024 | Wuertenberger | B24B 7/182 |
| 2008/0132155 | A1 * | 6/2008 | Thysell | B24B 41/047 451/271 |
| 2017/0072526 | A1 * | 3/2017 | Richardson | B24B 41/02 |
| 2018/0104850 | A1 * | 4/2018 | Guazzoni | B28D 1/043 |

* cited by examiner see-saw alternate drive wheels

METHOD AND APPARATUS FOR APPLYING A UNIFORM TEXTURE TO AN AGGREGATE SURFACE

CROSS-REFERENCE TO RELATED APPLICATIONS

This application is the National Stage of International Application No. PCT/US2020/059709, filed Nov. 9, 2020, which claims priority to U.S. 62/932,626, filed Nov. 8, 2019, which are entirely incorporated herein by reference.

FIELD OF THE INVENTION

The present disclosure, relates generally to a method and apparatus for applying an even textured finish to, and/or polishing or buffing, the surface of stone, aggregate material, or the like, and more particularly to applying said finish to a flat, curvilinear, concave or convex surface that may be oriented at an infinite degree of angles and orientations.

BACKGROUND OF THE INVENTION

The art of texturing or polishing a horizontal concrete surface, such as a floor, is known. In this instance, the weight of the apparatus applying the texture remains constant under the uniform force of gravity producing a flat level polished surface. Heretofore, applying a texture to, and/or polishing, any surface other than substantially horizontal, has been accomplished, for the most part, by hand holding the texturing apparatus against the surface to be textured or polished. However, as noted in U.S. Pat. Nos. 9,505,099, 10,414,011, and 10,682,735 (all of which are incorporated as if fully set forth herein), texturing or polishing any surface other than substantially horizontal in this fashion lacks the benefit of gravity to exert a uniform and even force across the surface, which results in a wavy or undulating finished surface due to the operator's inability to apply, by hand, and maintain a constant and uniform pressure with the hand held texturing tool.

SUMMARY

The present disclosure is directed to an apparatus, system and method for texturing, polishing, buffing or otherwise applying a finish (referred to herein generally as "texturing") to any aggregate, stone or the like surface from horizontal to vertical surface, such as but not limited to any flat, curvilinear, concave or convex surface. In one or more embodiments, the present disclosure is directed to an apparatus, system and method for exerting a substantially constant pressure to a texturing head juxtaposed to and in selective contact with a work surface.

The work surface can be a position at any angle or orientation. For example, the work surface can be a vertical surface (such as a wall), a semi-spherical surface, an arcuate surface (such as the interior surface of an arch) or any combination thereof. In some embodiments, the work surface is a rough and/or uneven surface of a wall comprising any face of a poured concrete structure, but is not limited to concrete or any poured aggregate structure.

In an embodiment, an apparatus is provided for texturing a work surface, for example a work surface comprised of aggregate, the apparatus comprising: a texturing carriage; a carriage rotation device coupled to the texturing carriage and configured to selectively rotate the texturing carriage; a vertical frame member configured to guide the texturing carriage or the carriage rotation device, or both, in a vertical direction in relation to a surface on which the apparatus rests; and a traversing device, the traversing device configured to move the apparatus along the surface on which the apparatus rests.

In any one or more aspects of any one or more embodiments herein, the traversing device can be configured to move the apparatus along the surface on which the apparatus rests in a direction substantially perpendicular to the vertical work surface. The apparatus can include a horizontal frame member supporting the vertical frame member, the traversing device attached to the horizontal frame member. The carriage rotation device can be configured to mount the texturing carriage. The carriage rotation device can be configured to rotate the texturing carriage about an axis substantially perpendicular to a vertical work surface or substantially parallel to the surface on which the apparatus rests, or both. The texturing carriage can be horizontally disposed in the apparatus in relation to the surface on which the apparatus rests. The texturing carriage can be substantially perpendicularly disposed in the apparatus in relation to a vertical work surface. The traversing device can comprise: a first drive motor; and a first drive wheel, the first drive wheel configured to move the horizontal base frame member in a first direction. The traversing device can comprise: a second drive motor; and a second drive wheel, the second drive wheel configured to move the horizontal base frame member in a second direction perpendicular to the first direction. The apparatus can include a horizontal frame member supporting the vertical frame member, the traversing device attached to the horizontal frame member, and the first drive wheel or the second drive wheel, or both, can be attached to the horizontal frame member, which can be a horizontal base frame member. The traversing device can comprise a guide roller configured to engage a track. The traversing device can comprise a guide roller configured to engage a track, the track positioned in the first direction. The apparatus can include a base pad and wherein the traversing device further comprises a guide roller configured to engage a track, the track mounted to the base pad. The traversing device can comprise: a wheel rotator, optionally having a lug; a drive wheel, optionally journaled in a bifurcated bracket comprising an aperture configured to receive the optional lug of the wheel rotator; and a drive motor, optionally journaled in a bifurcated bracket, and configured to drive the drive wheel forming a steerable wheel unit configured to be selectively rotated by the wheel rotator. The texturing carriage can comprise a texturing head configured to hold one or more texturing pads and a texturing head motor, the texturing head motor configured to move the one or more texturing pads across a work surface and wherein the texturing carriage can be configured to extend and retract the texturing head towards and away from the work surface. The texturing head can be configured to hold one or more texturing pads and the texturing head can be mounted to the texturing carriage and the texturing head configured to be pivoted about the texturing carriage by at least 90 degrees between a position wherein the texturing pads engage a vertical work surface and wherein the texturing pads engage a horizontal work surface. The texturing carriage can comprise a cradle to which the texturing head can be connected and means for extending and retracting the cradle, and thereby the texturing head, towards and away from a work surface. The texturing head can be pivotally connected to the cradle and the texturing head can be configured for pivotal movement about the texturing carriage by at least 90 degrees between a position wherein the texturing pads engage a vertical work surface and wherein the texturing pads engage a horizontal work surface. The texturing carriage can comprise: a pair of pillow blocks positioned on a pair of opposed posts, the pillow blocks configured to journal the texturing head to provide pivotal connection of the texturing head to the cradle, each post upstanding at a distal end of a pair of slidable guide arms; the cradle comprising one or more guide rollers, the guide rollers rotatably fixed to the cradle; and the means for extending and retracting the cradle including a pneumatic cylinder fixed to the cradle and connected to a connector dowel via a piston rod, the connector dowel fixed to the slidable guide arms and configured to provide unitary movement of the guide arms. The texturing carriage can be connected to one or more slidable guide arms via rotators fixed at distal ends of one or more slidable guide arms, each rotator having a rotation portion and a non-rotating portion, the rotation portion configured to rotate the texturing head to a radial position. The texturing carriage can comprise: a linear texturing arm; one or more telescoping arms configured to support the linear texturing arm, each telescoping arm having a piston arm, the piston arm configured to urge the linear texturing arm against a surface to be textured; and the one or more telescoping arms attached to a rotation shaft configured to attach to the carriage rotation device. The linear texturing arm can comprise an elongated mounting bar having a plurality of apertures, the apertures configured to receive drive shafts from a plurality of texturing bit assemblies, each texturing bit assembly connected to a drive gear, and driven by a drive motor; and a first telescoping arm and a second telescoping arm configured to support the linear texturing arm, each telescoping arm having an outer sleeve and a piston arm, the piston arm configured to urge the linear texturing arm against a surface to be textured, wherein the first telescoping arm is attached to an outer sleeve of a rotation shaft configured to attach to the carriage rotation device and the second telescoping arm is attached to an inner sleeve of the rotation shaft.

In an embodiment, an apparatus is provided for texturing a work surface, for example a work surface comprised of aggregate, the apparatus comprising: a texturing carriage, the texturing carriage including a texturing head configured to hold one or more texturing pads and a texturing head motor, the texturing head motor configured to move the one or more texturing pads across a work surface and wherein the texturing carriage is configured to extend and retract the texturing head towards and away from the work surface; and a carriage rotation device coupled to the texturing carriage and configured to selectively rotate the texturing carriage about an arch. The arch can be about 180 degrees. The carriage rotation device coupled to the texturing carriage can be configured to selectively rotate the texturing carriage about an axis that is substantially parallel to a surface on which the apparatus rests. The work surface can be an arcuate or curved work surface. The work surface can be a concave work surface and the apparatus can be positioned inside the concavity of the work surface. The work surface can be a semi-spherical work surface and the apparatus can be positioned within the semi-spherical work surface. The texturing head can include a plurality of texturing pads and the texturing head motor can be coupled to a plurality of gears, each gear coupled to one of the plurality of texturing pads. The apparatus can include: a vertical frame member configured to guide the texturing carriage or the in a vertical direction in relation to a surface on which the apparatus rests; or a traversing device, the traversing device configured to move the apparatus along the surface on which the apparatus rests; or both. The traversing device can be configured to move the apparatus along the surface on which the apparatus rests in a direction substantially perpendicular to the vertical work surface. The apparatus can include a horizontal frame member supporting the vertical frame member, the traversing device attached to the horizontal frame member. The apparatus can include a carriage rotation device coupled to the texturing carriage and configured to selectively rotate the texturing carriage. The carriage rotation device can be configured to mount the texturing carriage. The carriage rotation device can be configured to rotate the texturing carriage about an axis substantially perpendicular to a vertical work surface or substantially parallel to the surface on which the apparatus rests, or both. The apparatus can include a traversing device, the traversing device configured to move the apparatus along the surface on which the apparatus rests, and wherein the traversing device comprises: a first drive motor; and a first drive wheel, the first drive wheel configured to move the horizontal base frame member in a first direction. The traversing device can comprise: a second drive motor; and a second drive wheel, the second drive wheel configured to move the horizontal base frame member in a second direction perpendicular to the first direction. The apparatus can include a horizontal frame member supporting the vertical frame member, the traversing device attached to the horizontal frame member, and the first drive wheel or the second drive wheel, or both, are attached to the horizontal base frame member. The traversing device can comprise a guide roller configured to engage a track. The traversing device can comprise a guide roller configured to engage a track, the track positioned in the first direction. The apparatus can include a traversing device, the traversing device configured to move the apparatus along the surface on which the apparatus rests, and a base pad, and wherein the traversing device further comprises a guide roller configured to engage a track, the track mounted to the base pad. The apparatus can include a traversing device, the traversing device configured to move the apparatus along the surface on which the apparatus rests, and the traversing device can comprise: a wheel rotator, optionally having a lug; a drive wheel, optionally journaled in a bifurcated bracket comprising an aperture configured to receive the optional lug of the wheel rotator; and a drive motor, optionally journaled in a bifurcated bracket, and configured to drive the drive wheel forming a steerable wheel unit configured to be selectively rotated by the wheel rotator. The texturing carriage can comprise: a cradle to which the texturing head is connected; and means for extending and retracting the cradle, and thereby the texturing head, towards and away from a work surface. The texturing carriage can comprise a cradle comprising one or more guide rollers, the guide rollers rotatably fixed to the cradle. The means for extending and retracting the texturing head can include a pneumatic cylinder fixed to a cradle to which the texturing head can be coupled and the cradle can include one or more slidable guide arms that are configured to provide unitary movement towards and away from a work surface. The texturing carriage can comprise a texturing head configured to hold one or more texturing pads, and the apparatus can include means for applying a desired pressure of the one or more texturing pads against a work surface. The texturing carriage can comprise a texturing head configured to hold one or more texturing pads, and the apparatus can include means for applying a desired constant pressure of the one or more texturing pads against a work surface. The means for applying a desired pressure of the one or more texturing pads against a work surface can include a tensioning device configured for variable pressure.

In another embodiment, an apparatus is provided for texturing a surface comprising: a frame, having a horizontal foot portion suited with leveling or tilting means and means for travel parallel to and along the surface to be textured as well as means for travel toward and away to engaged and disengaged from the surface to be textured; a vertical mast portion extending from the traveling foot portion that carries a substantially vertical traversing sub-frame. Fixed to the vertical traversing sub-frame is a texturing carriage. The carriage is attached to the sub-frame via a rotation assembly that enables the carriage to be rotated with respect to the main frame, and vertically movable sub-frame assembly. The carriage assembly is suited with an energizing means, as an example a reversible variable speed motor suited with a pinion gear. The energizing means engages a stationary gear, such as a stationary ring gear, fixed to the sub-frame, whereby the carriage assembly can be rotated in a clockwise or counter clockwise direction and stopped at any desired position.

The rotation assembly connecting the carriage assembly and the sub-frame can include a proximal side and a distal side. The proximal side can be suited with a ring gear and rigidly mounted or fixed to the movable sub-frame. The juxtaposed distal side can be a disc shaped portion journaled for rotation on a stub shaft or axle connecting the two parts for rotation about their shared central axis. The distal disc shaped part of the two-part rotation device can be rigidly attached to a slide carriage frame. A motor, such as a reversible motor, is attached and fixed to the slide carriage frame. The motor can be suited with a gear, such as a pinion gear, having teeth that engage and mesh with the gear teeth of the gear teeth of the proximal side of the rotation device. Energizing the motor causes the slide frame carriage to rotate on the axle with respect to the vertically slidable sub-frame.

The slide frame can include a slide assembly, a texturing head, the texturing head including at least one motor and at least one finishing pad, the at least one finishing pad configured to be movable across a work surface; a motor configured to move the at least one finishing pad across the work surface; the slide mounted to the frame substantially perpendicular to the work surface and configured to be movable with respect to the frame towards and away from the work surface; and a tensioning device configured to provide a relative constant pressure between the texturing device and the work surface.

In an embodiment, a system is provided comprising: a main frame, a sub-frame, a slide carriage, the carriage including a frame and a slide, the slide including a texturing head, the texturing head including at least one motor and at least one finishing pad, the at least one finishing pad configured to be movable across a work surface, a motor configured to move the at least one finishing pad across the work surface; the slide mounted to the frame substantially perpendicular to the work surface and configured to be movable with respect to the frame towards and away from the work surface; and a tensioning device configured to provide a pressure between the frame and the slide for controlling the pressure of the at least one finishing pad against the work surface.

In any one or more aspects the apparatus or system, or both, can include any one or more of the following. The apparatus or system, or both, can include a track assembly configured to allow movement of the carriage or frame along the track assembly from one location of the work surface to another location of the work surface. A lift mechanism can be included, the lift mechanism configured to raise and lower the texturing head in relation to the work surface. The lift mechanism can include a first end configured to contact a floor or ground surface and a second end connected to the carriage or frame, and the track assembly can be connected to the second end of the lift mechanism. The track assembly can include at least one track configured for placement substantially planar to the work surface. The track assembly can be positioned substantially perpendicular to the slide. The motor can be pivotally attached to the texturing head. The tensioning device can be configured to provide a substantially constant pressure of the at least one finishing pad against the work surface. The slide can further include a pair of arms and the texturing head can be attached between a first end of the pair of arms, and a cross-member can be attached between a second end of the pair of arms against which the tensioning device can provide the pressure between the slide and the frame.

In an embodiment, method is provided for using the apparatus of any one or more embodiments and in any one or more aspects described herein.

In an embodiment, a method for texturing a surface, for example a work surface comprised of aggregate, the method comprising the steps of:

a) providing the present apparatus of any one or more embodiments and in any one or more aspects described herein
b) positioning the texturing carriage in relation to a work surface and placing the one or more texturing pads in contact with the work surface;
c) using the texturing head motor to move the one or more finishing pads across the work surface; and
d) using the vertical frame member or the traversing device, or both, to move the apparatus in a path substantially parallel to the work surface while maintaining the one or more texturing pads in contact with the work surface and while using the motor to move the one or more texturing pads across the work surface.

In any one or more aspects of any one or more embodiment of a method described herein, the method can include the step of adjusting a pressure to apply a desired pressure of the one or more texturing pads against the work surface. The method can include the step of adjusting a pressure of the tensioning device to apply a desired pressure of the one or more texturing pads against the work surface includes adjusting the pressure to provide a constant pressure of the one or more texturing pads against a work surface. The method can include the step of adjusting a pressure of the tensioning device to apply a desired pressure of the one or more texturing pads against the work surface includes adjusting a tensioning device configured for variable pressure to provide a desired pressure or a desired constant pressure of the one or more texturing pads against a work surface. The method can include the step of rotating the texturing carriage about an axis substantially perpendicular to a vertical work surface or substantially parallel to the surface on which the apparatus rests, or both. The method can include the step of pivoting the texturing head about the texturing carriage by at least 90 degrees between a position wherein the texturing pads engage a vertical work surface and wherein the texturing pads engage a horizontal work surface. The method can include the step of selectively rotating the texturing carriage about an arch. The arch can be about 180 degrees. The method can include the step of selectively rotating the texturing carriage about an axis that is substantially parallel to a surface on which the apparatus rests. The work surface can be an arcuate or curved work surface. The work surface can be a concave work surface and the apparatus can be positioned inside the concavity of the work surface. The work surface can be a semi-spherical work surface and the apparatus can be positioned within the semi-spherical work surface.

In any one or more aspects the apparatus or system, or both, can further include a track assembly configured to allow movement of the carriage or frame along the track assembly from one location of the work surface to another location of the work surface. A lift mechanism can be included, the lift mechanism configured to raise and lower the texturing head in relation to the work surface. The lift mechanism can include a first end configured to contact a floor or ground surface and a second end connected to the carriage or frame, and the track assembly can be connected to the second end of the lift mechanism. The track assembly can include at least one track configured for placement substantially planar to the work surface. The track assembly can be positioned substantially perpendicular to the slide. The motor can be pivotally attached to the texturing head. The tensioning device can be configured to provide a substantially constant pressure of the at least one finishing pad against the work surface. The slide can further include a pair of arms and the texturing head can be attached between a first end of the pair of arms, and a cross-member can be attached between a second end of the pair of arms against which the tensioning device can provide the pressure between the slide and the frame.

In an embodiment, a method is provided for texturing a surface. The method can include a) providing the present apparatus or system in any one or more aspects. The method can further include: b) positioning the frame in relation to the work surface and placing the finishing pad in contract with the work surface; c) adjusting a pressure of the tensioning device to apply a desired pressure of the finishing pad against the work surface; d) using the motor to move the finishing pad across the work surface; and e) moving the frame in a path across the work surface while maintaining the finishing pad in contact with the work surface and while using the motor to move the finishing pad across the work surface.

In any one or more aspects, the method can further include sliding or moving the slide towards and/or away from the work surface to position the finishing pad in contact with the work surface or retract the finishing pad away from the work surface or both. The texturing device can include a track assembly configured to allow movement of the frame along the track assembly from one location of the work surface to another location of the work surface, and the method can further include the step of moving the frame along the track assembly from one location of the work surface to another location of the work surface. The texturing device can include a lift mechanism configured to rise and lower the carriage in relation to the work surface, and the method can further include the step of using the lift mechanism to position the finishing pad in relation to the work surface. The tensioning device can be used to provide the desired pressure by providing pressure between the slide and the frame.

In any one or more aspects of the apparatus, system and/or method, the work surface can be a surface of a wall, for example a substantially vertical surface. The at least one finishing pad can be at a polishing pad, a buffing pad, a sanding pad, and/or a texturing pad for providing a desired texture to the work surface. The pressure between the finishing pad and the work surface can be a substantially constant pressure. The finishing pad can be moved in a direction substantially planar to the work surface. The frame can be moved in a path generally parallel to the work surface, either horizontally, vertically, or both, or anywhere in between horizontal and vertical.

Thus, in any one or more aspects, a texturing or surfacing apparatus is provided that can be positioned or supported adjacent a substantially vertical surface of a structure for applying an even and uniform texture to the surface of the structure using a selectively adjustable force exerted on a texturing means to engage the surface of the structure. The texturing apparatus can be suited for horizontal and vertical movement in controlled prescribed paths under controlled and prescribed pressure from the adjustable tensioning means to provide the desired texture to the structure.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the various views.

A full and enabling disclosure of the present disclosure, including the best mode thereof, is directed to one of ordinary skill in the art, is set forth more particularly in the remainder of the specification, which makes reference to the appended FIGS, in which.

Figure 1:
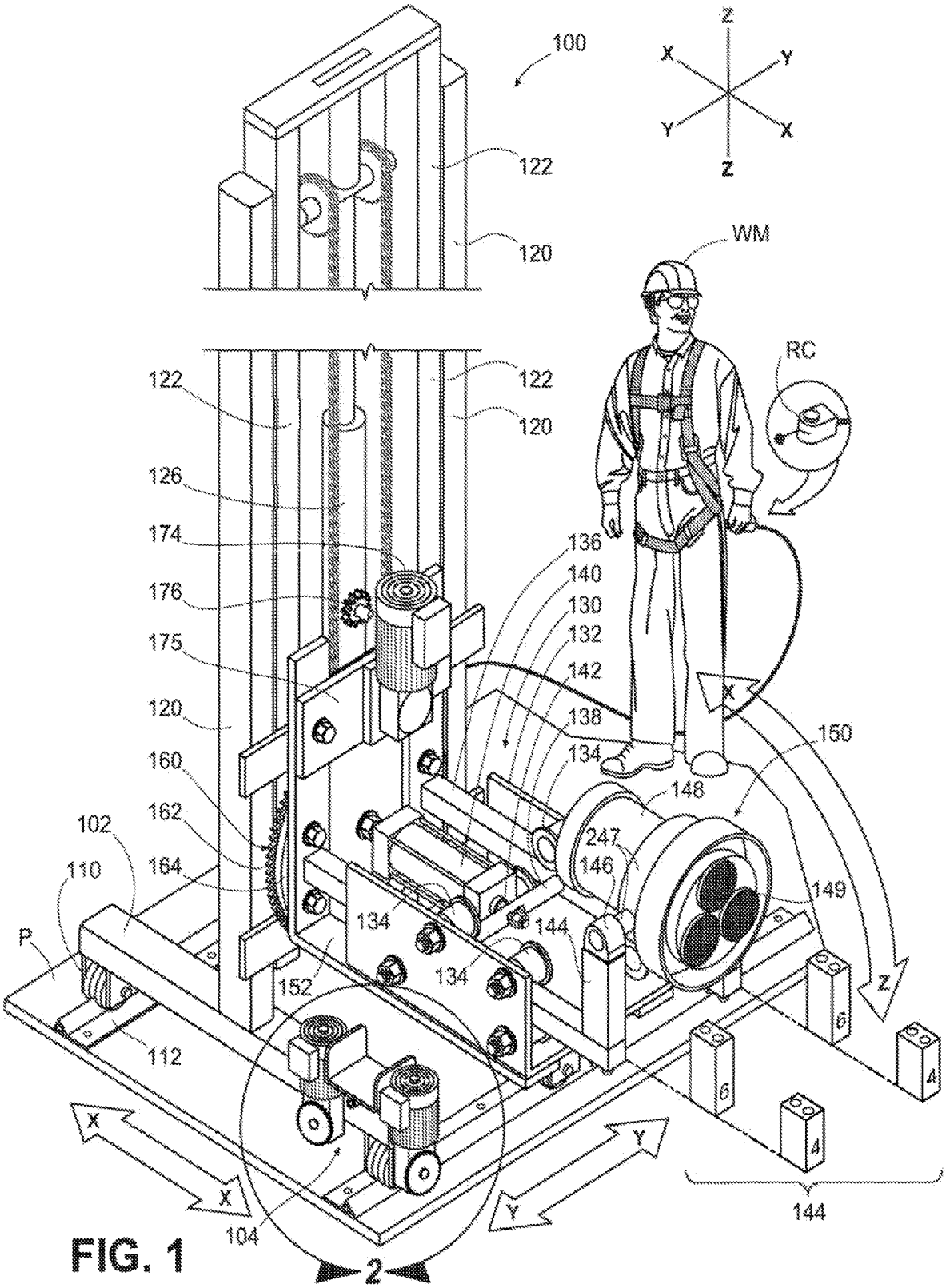
FIG. 1 is an isometric view showing a one embodiment of the of the overall constant pressure texturing apparatus.

Repeat use of reference characters in the present specification and drawings is intended to represent the same or analogous features or elements of the disclosure.

DETAILED DESCRIPTION

Described below are various embodiments of the present systems and methods for texturing a surface, for example a substantially vertical surface. Although particular embodiments are described, those embodiments are mere exemplary implementations of the system and method. One skilled in the art will recognize other embodiments are possible. All such embodiments are intended to fall within the scope of this disclosure. Moreover, all references cited herein are intended to be and are hereby incorporated by reference into this disclosure as if fully set forth herein. While the disclosure will now be described in reference to the above drawings, there is no intent to limit it to the embodiment or embodiments disclosed herein. On the contrary, the intent is to cover all alternatives, modifications and equivalents included within the spirit and scope of the disclosure.

The present disclosure provides a variety of texturing devices that when positioned in contact with a work surface can provide a smooth and continuous textured surface under a constant pressure between the texturing device and the working surface. In various aspects the working surface can be a substantially vertical surface. A variety of movements and configurations allow the texturing device to move planar to a substantially vertical surface, for example, a wall. Additionally, a variety of controls allow either a user or computer to operate the texturing device. The controls can include moving the texturing device planar to the working surface, moving the texturing device toward and away from the working surface, and varying the tension applied to the texturing device to vary the pressure between the texturing device and the working surface, preferably to cause the texturing device to apply a constant pressure against the working surface. Additionally, in various aspects a method is provided for applying a uniform texture to a working surface. In addition to the previously stated attributes and capabilities, the description to follow will provide for and accommodate angled, curved or any combination of surfaces where texturing or polishing is desired.

Reference will now be made in detail to various embodiments of the disclosure, one or more examples of which are illustrated in the drawings. It is intended that the present disclosure include these embodiments and other modifications and variations as will be obvious to one skilled in the art.

Depicted in FIG. 1 is a first embodiment of the texturing apparatus or device 100 of the present disclosure. The texturing device 100 is suited with horizontal base frame members 102. The frame members 102 are suited with traversing assemblies 104 at each distal end thereof. The traversing assemblies 104 are suited with drive wheels 106, such as cogwheels, capable of selectively engaging the surface of a base pad P to move the texturing device 100 back and forth in a Y direction, along with, and parallel to, the surface S of the area to be textured via drive motors 108. Assemblies 104 may be suited with grooved guide rollers 110 which engage an angled track 112 mounted to the pad P running parallel to the surface S to be textured. Traversing assemblies 104 may be similarly suited with drive wheels 114, such as cogwheels, driven by driven drive motor 116 to selectively impart movement to the device 100 along an X direction, perpendicular to, and toward and away from the surface S to be textured.

Fixed to horizontal base frame members 102, are upright, vertical column frame members 120. These frame members act as guides for each side of a sub-frame 122. Sub-frame 122 can be suited for vertical movement via lifting/lowering chains 124 which, when acted upon by hydraulic or pneumatic cylinder 126, may selectively position a texture head carriage 130 to any desired vertical position, the detailed design and workings of which can be similar to a standard forklift.

Figure 16:
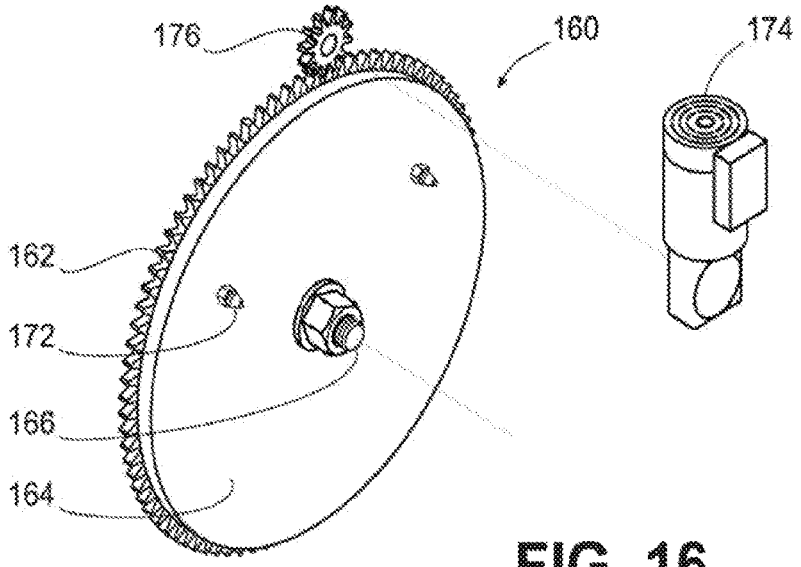
FIG. 16 shows an isometric view of the carriage rotation assembly.
Figure 17:
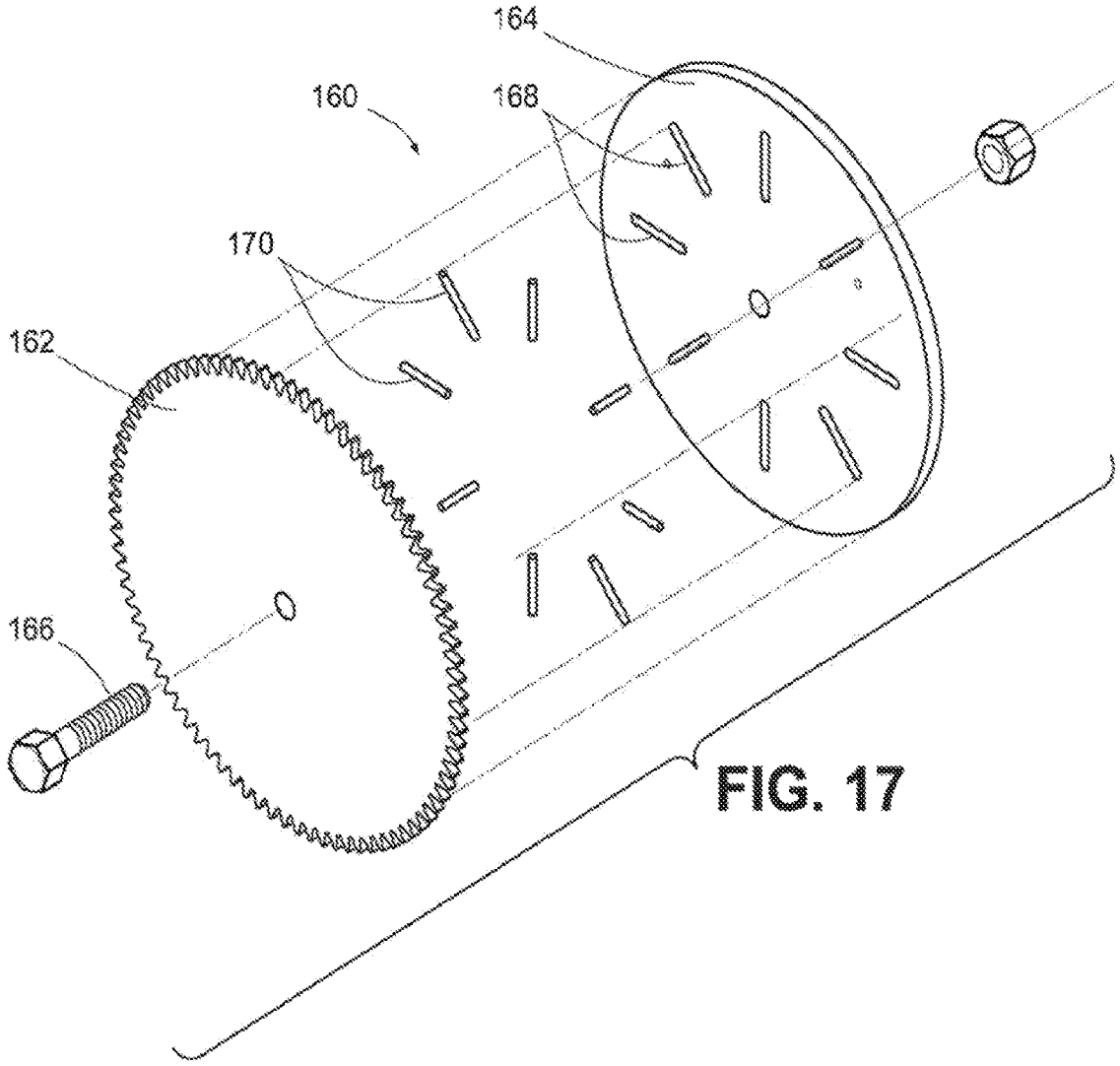
FIG. 17 is an exploded isometric view of the carriage rotation assembly illustrated in FIG. 16.
Figure 18A:
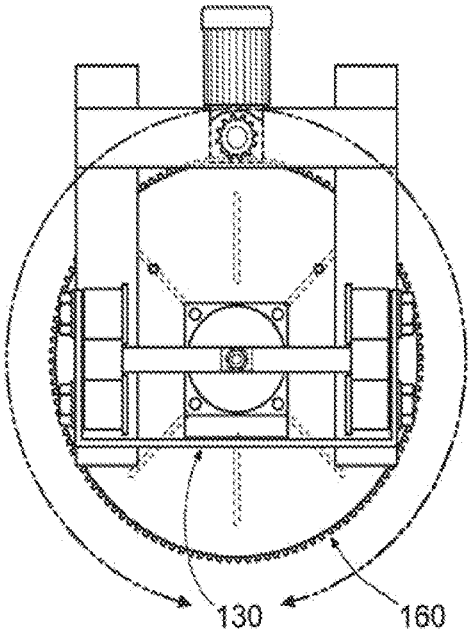
FIG. 18A is a front elevation view is a front elevation view of the carriage and carriage at top dead center via the rotation assembly.
Figure 18B:
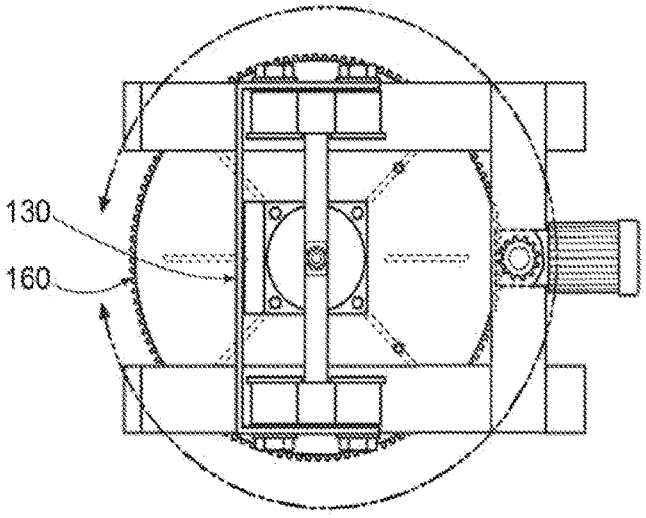
FIG. 18B is a front elevation view with the carriage rotated 90 degrees from the position illustrated in FIG. 16A via the rotation assembly.
Figure 18C:
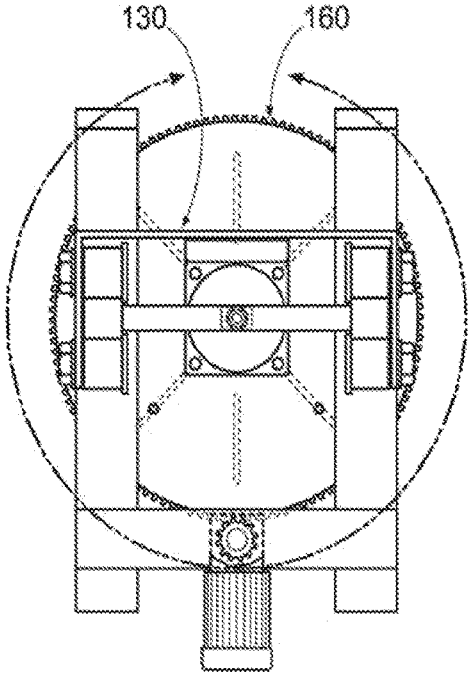
FIG. 18C is a front elevation view with the carriage rotated 90 degrees from the position illustrated in FIG. 16B, via the rotation assembly.
Figure 18D:
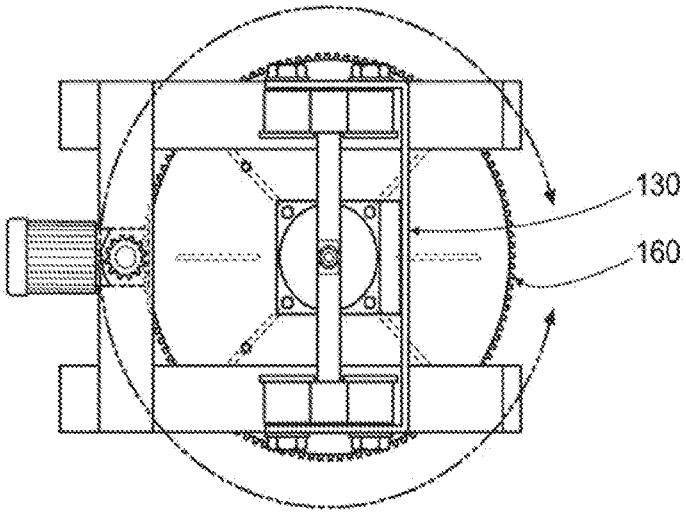
FIG. 18D is a front elevation view with the carriage rotated 90 degrees from the position illustrated in FIG. 16C, via the rotation assembly.

The texture head carriage 130 can be fixedly mounted to a carriage rotation assembly 160, shown in FIG. 1 and seen more clearly in FIGS. 16 and 17.

The carriage 130 can consist of a "U" shaped cradle 132 having a pair of guide rollers 134 rotatably fixed to each side to journal a pair of slidable guide arms 136 there between.

A guide arm connector dowel 138 can span and be fixed to each guide arm 136 to provide for unitary movement of the arms 136. A pneumatic cylinder 140 can be attached via piston rod 142 to the connector dowel 138. The opposite end of the cylinder 140 can be fixed within the cradle 132. At the distal ends of the arms 136 are upstanding extension posts 144. These posts can be interchangeable in pairs, depending on the height desired. Atop the posts 144 are pillow blocks 146 which journal a texture head motor 148 suited with texturing or polishing pads 149, which, together form the texturing head 150.

The texturing carriage 130 can rest upon and be fixed to a pair of "L" shaped carriage support arms 152 that are, in turn, fixed to the vertical members of the movable sub-frame 122.

FIG. 1 shows a workman WM in conjunction with the texturing apparatus or texturing machine 100 and holding a remote controller RC. Alternately, the controller could be a wireless remote controller (not shown).

It will become clear, to one skilled in the art, that this texturing device can be moved to an infinite number of positions and or orientations to carry out texturing or polishing operations ranging from simple to compound and complex tasks requiring a minimum of skilled labor.

Figure 2:
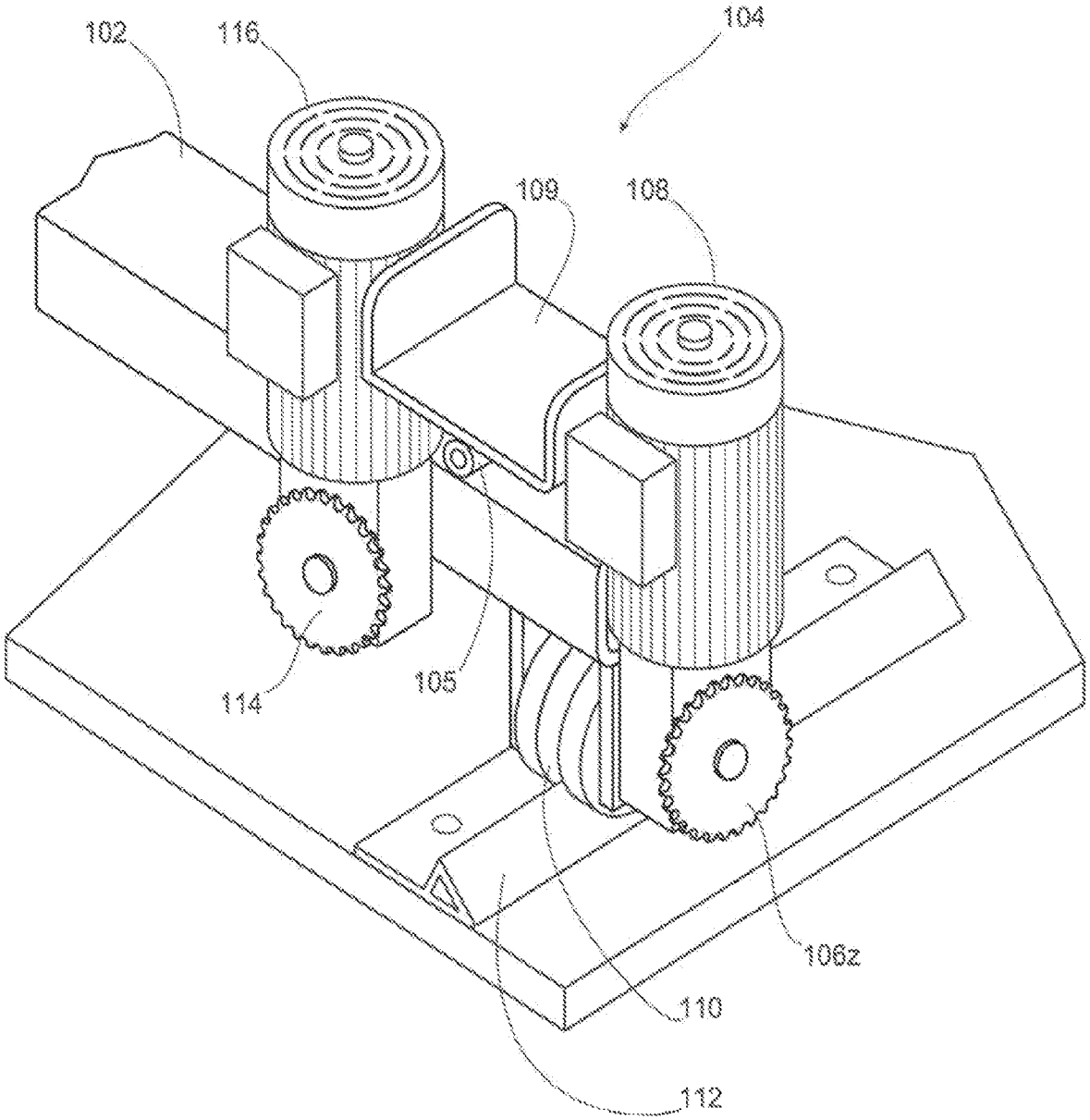
FIG. 2 is an enlarged isometric view of one of the X-Y drive mechanisms taken at inset circle 2 in FIG. 1.
Figure 3A:
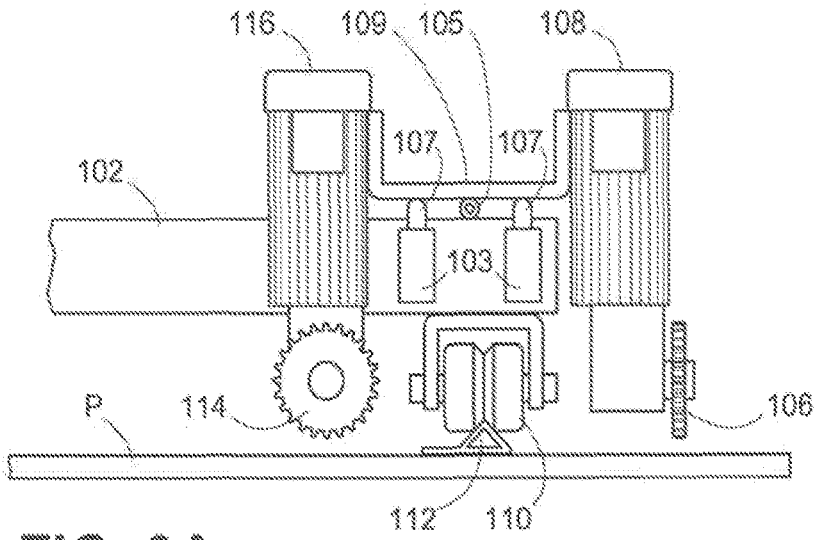
FIG. 3A is a side elevation of the drive mechanism shown in FIG. 2 with the drive wheels shown in a neutral non-drive position.
Figure 3B:
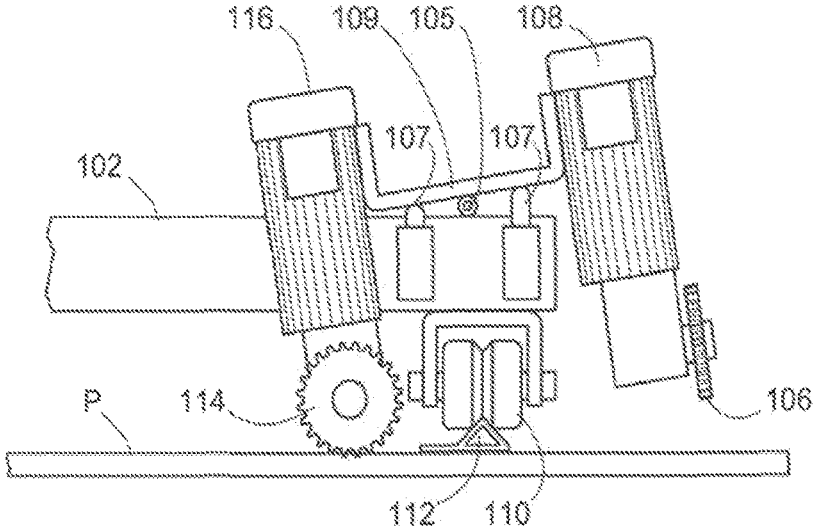
FIG. 3B is a side elevation of the drive mechanism, similar to FIG. 3A, and showing the drive wheels engaged to transport the texturing apparatus along the X axis.
Figure 3C:
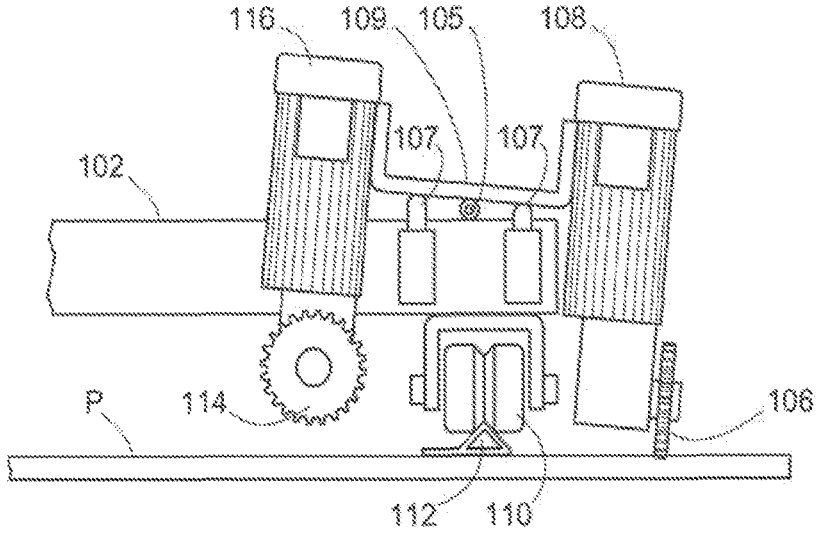
FIG. 3C is a side elevation of the drive mechanism, similar to FIGS. 3A and 3B and showing the drive wheels engaged to transport the texturing apparatus along the Y axis.

FIG. 2 and FIGS. 3A-C depict longitudinal and transverse drive unit detail of the texturing apparatus or device 100. FIG. 2 is an enlargement of a detail of one traversing assembly 104 and shows the drive cogwheel 106 journaled to motor 108. Motor 108 can be attached to a "U" shaped bracket 109. Attached to the bracket 109, opposite the motor 108 is attached drive motor 116. Attached to the bottom surface of bracket 109 is a hinge 105. Referring now to FIG. 3A, there are a pair of plungers 103 mounted to frame member 102. Each plunger can be suited with a piston 107. A plunger can be associated with each drive motor. The pistons 107 of the plungers are partially extended to engage the bottom surface of the bracket 109. Referring now to FIG. 3B, the piston 107 associated with the motor 108 is extended and engaging the bottom surface of the bracket 109. Alternately, the opposite piston 107 associated with motor 116 can be retracted, causing the bracket 109 to tilt on the hinge 105, whereby the wheel 114, such as a cogwheel, engages the top surface of the pad P. to drive the texturing device along the Y direction. FIG. 3C illustrates the alternate wheel engagement to drive the texturing device in the X direction.

Figure 4A:
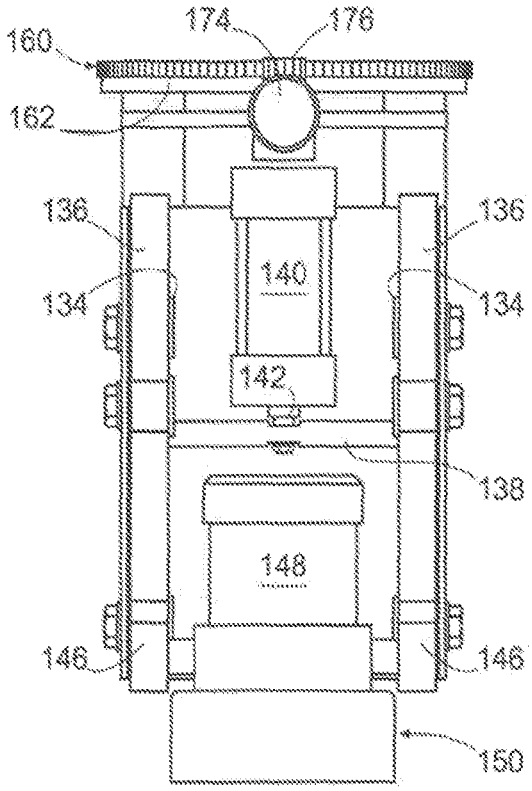
FIG. 4A is a top plan view of the texturing carriage portion with the texturing head retracted to its home position.
Figure 4B:
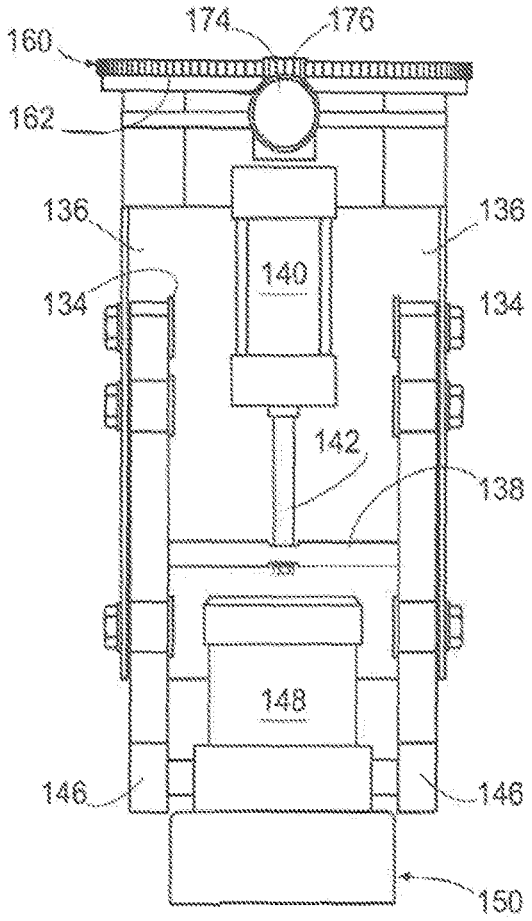
FIG. 4B is a top plan view, similar to FIG. 4A, of the texturing carriage portion with the texturing head extended.

FIG. 4A shows a top plan of the drive carriage 130 and carriage rotation device 160, with the texturing head 150 retracted. FIG. 4B is a similar view to 4A showing the texturing head extended.

Figure 5A:
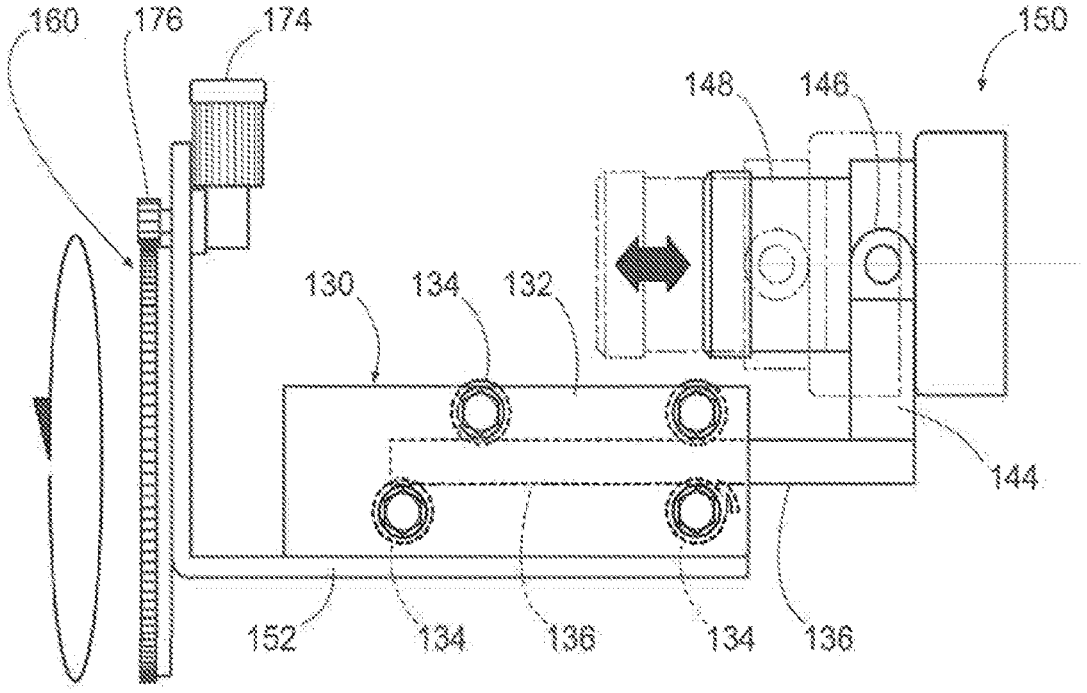
FIG. 5A is a side elevation of the texturing carriage portion with the texturing head extended and positioned horizontally and at top dead center.
Figure 5B:
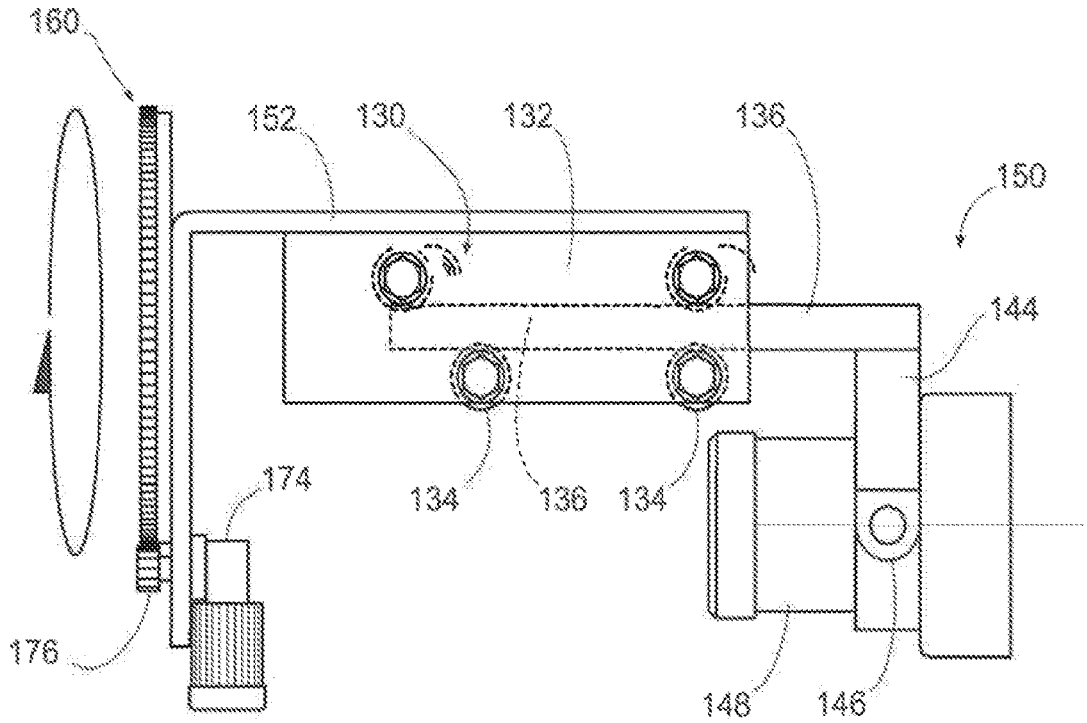
FIG. 5B is a side elevation of the texturing carriage portion, similar to FIG. 5A, with the texturing head extended and positioned horizontally and at bottom dead center.
Figure 5C:
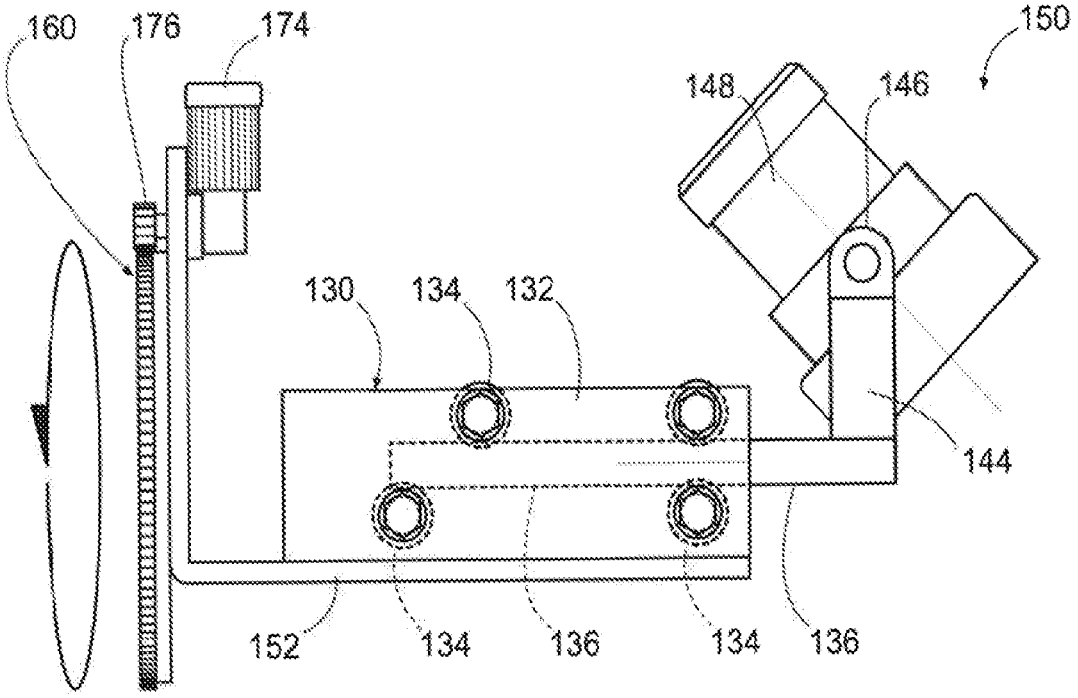
FIG. 5C is a similar side elevation of the texturing carriage with the texturing head extended, positioned at top dead center with the texturing head rotated at 45 degrees off of horizontal.
Figure 5D:
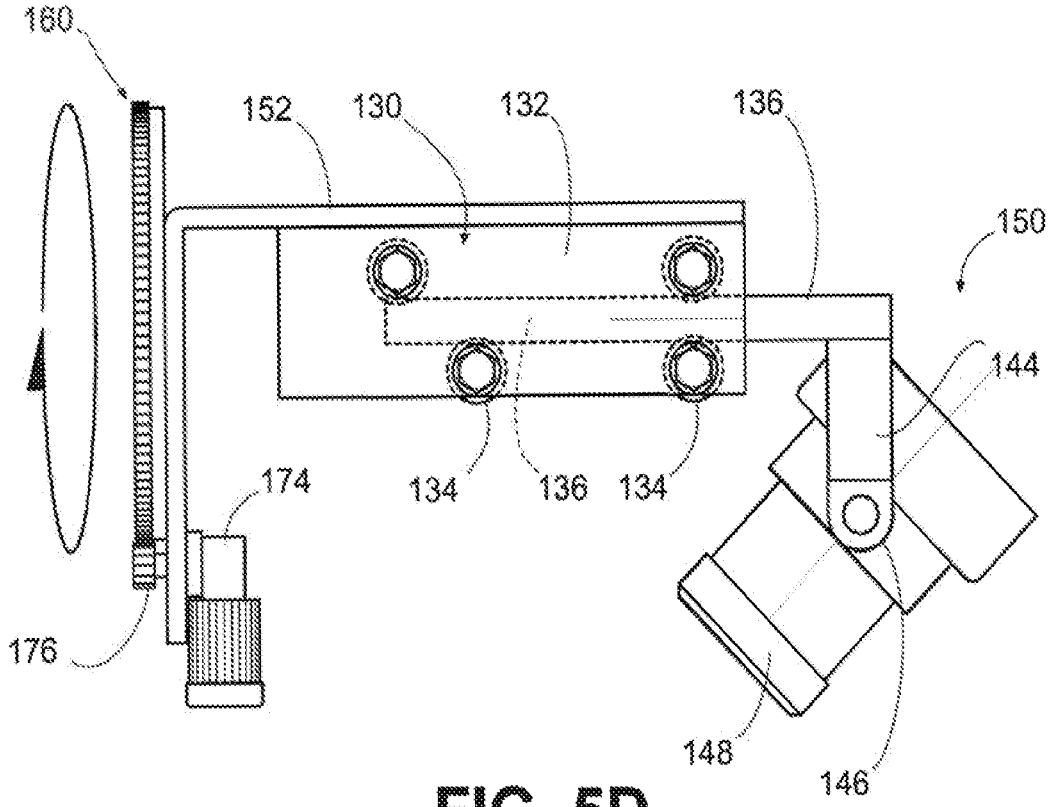
FIG. 5D is a side elevation of the texturing carriage, similar to FIG. 5A, with the texturing head extended, positioned at bottom dead center with the texturing head rotated 45 degrees off of horizontal.

FIGS. 5A-D depict various possible texture head 150 positions. FIG. 5A is a side elevation of the carriage 130 and rotation device 160 at the twelve o'clock position. FIG. 5B is a similar view showing the carriage 130 and rotation device 160 at the six o'clock position. FIG. 5C is a side elevation, similar to FIG. 5A in which the motor 148 is rotated at top center 45 degrees. FIG. 5D is a side elevation, similar to FIG. 5B with the motor rotated at bottom dead center 45 degrees.

Figure 6:
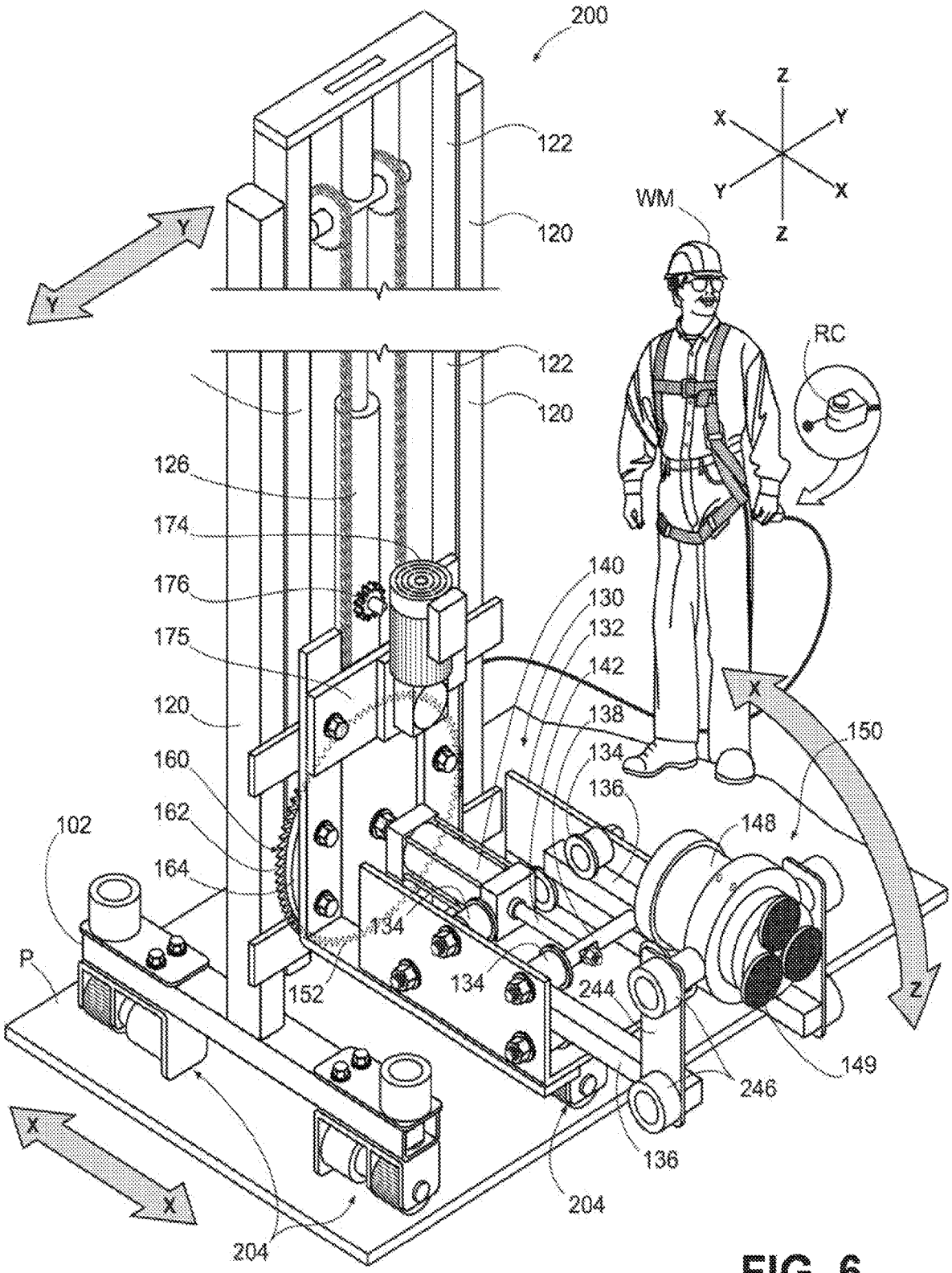
FIG. 6 is an isometric view of an alternate embodiment of the overall constant pressure texturing apparatus.

FIG. 6 is an isometric view of an alternate embodiment of the texturing device 200 having alternative rotary actuators and transport assemblies. The texturing device 200 in FIG. 6 is suited with alternate traversing assemblies 204 attached to the horizontal frame members 102. The texturing carriage 130 can be suited with texturing head rotation devices 246 that may be electronic servo motors, pneumatic or hydraulic rotation devices, or the like to rotate the texturing head 150 to any desired radial position.

Figure 7:
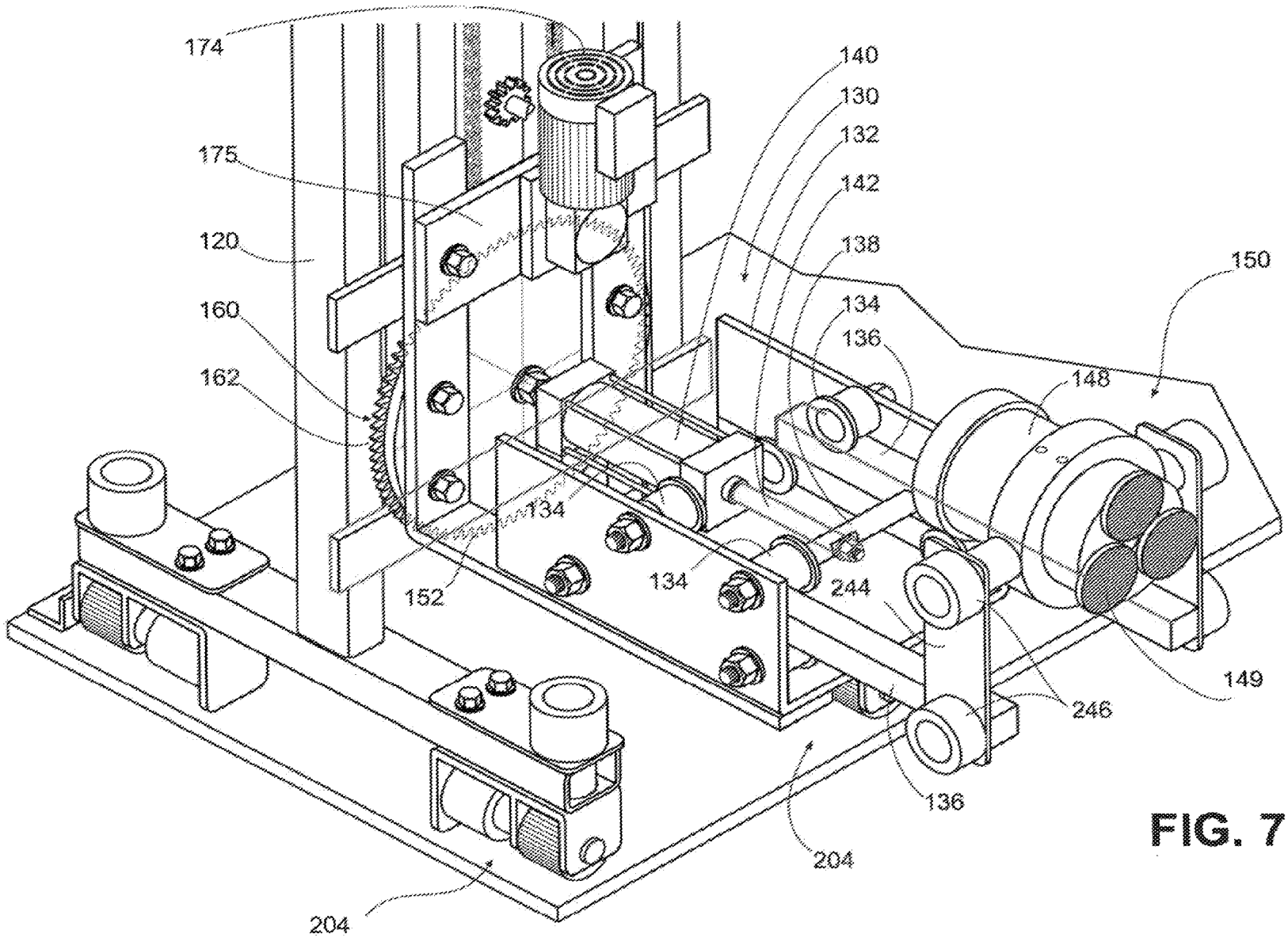
FIG. 7 is an enlarged isometric view of a fragmentary portion of the texturing apparatus shown in FIG. 6.
Figure 8:
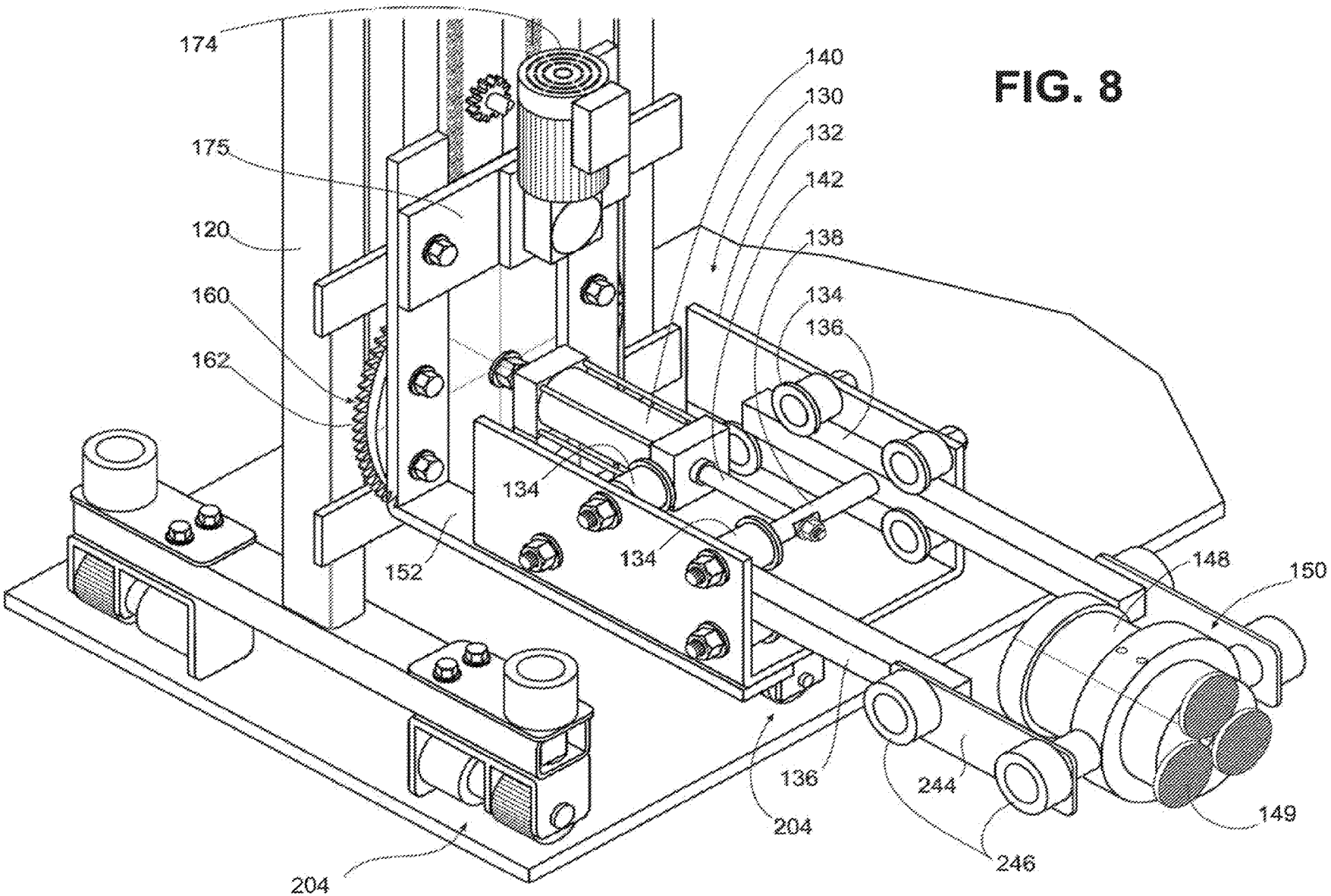
FIG. 8 is an isometric view, similar to FIG. 7 with the texturing head rotated to an alternate position.
Figure 9:
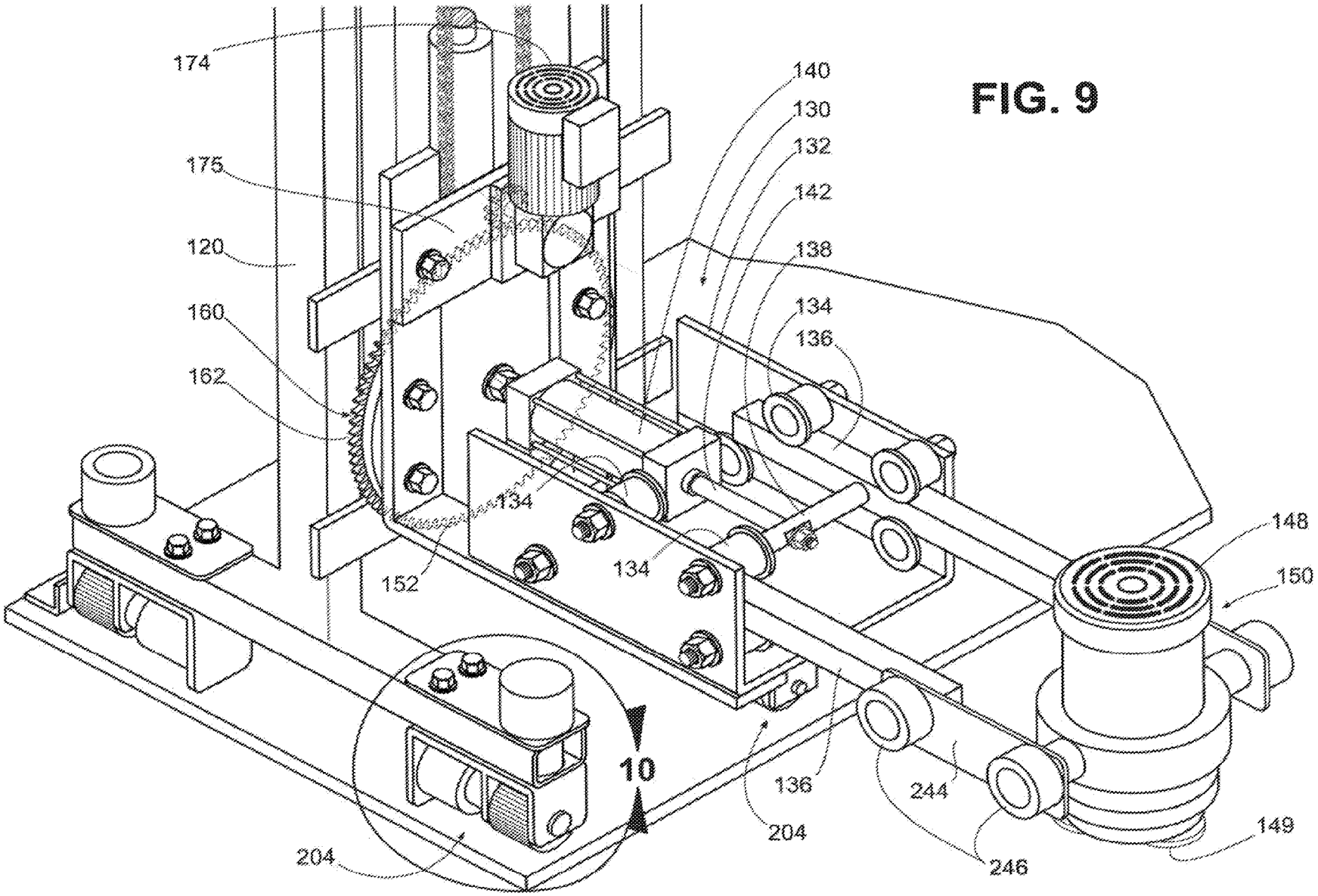
FIG. 9 is an isometric view, similar to FIG. 8 with the texturing head rotated to a still further alternate position.

FIG. 7 is an enlarged fragmentary portion of FIG. 6 and shows lower rotation devices 246, the non-rotating portion of rotator 246 is fixed to the distal ends of arms 136. The rotating portion of rotator 246 is fixed to a link arm 249. The non-rotating portion of upper rotator 246 is fixed to the upper distal end of link arm 244 with its rotating portion fixed to axle and mounting ring 247 whereby energizing the upper and or lower rotators 246 will reposition the motor 148 in an infinite number of orientations. FIG. 8 is a view similar to FIG. 7, and shows an alternate position of the texturing motor 148 wherein the lower, proximal rotator 246 is rotated 90 degrees in the clockwise direction and upper, or distal rotator 246 is rotated 90 degrees in the counter-clockwise direction, whereby the motor 148 is extended and in axial alignment with the rotation device 160. FIG. 9 is similar to FIG. 8 and shows the distal rotator 246 rotated 90 degrees in the clockwise direction to position the texturing motor 148 to face downward in position to texture a substantially horizontal surface.

Figure 10:
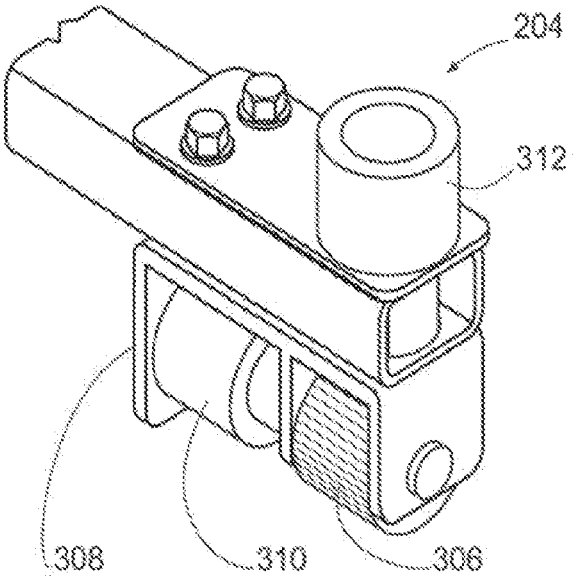
FIG. 10 is an isometric detail view taken at inset circle 10 in FIG. 9 and shows an alternate frame traversing apparatus.
Figure 11:
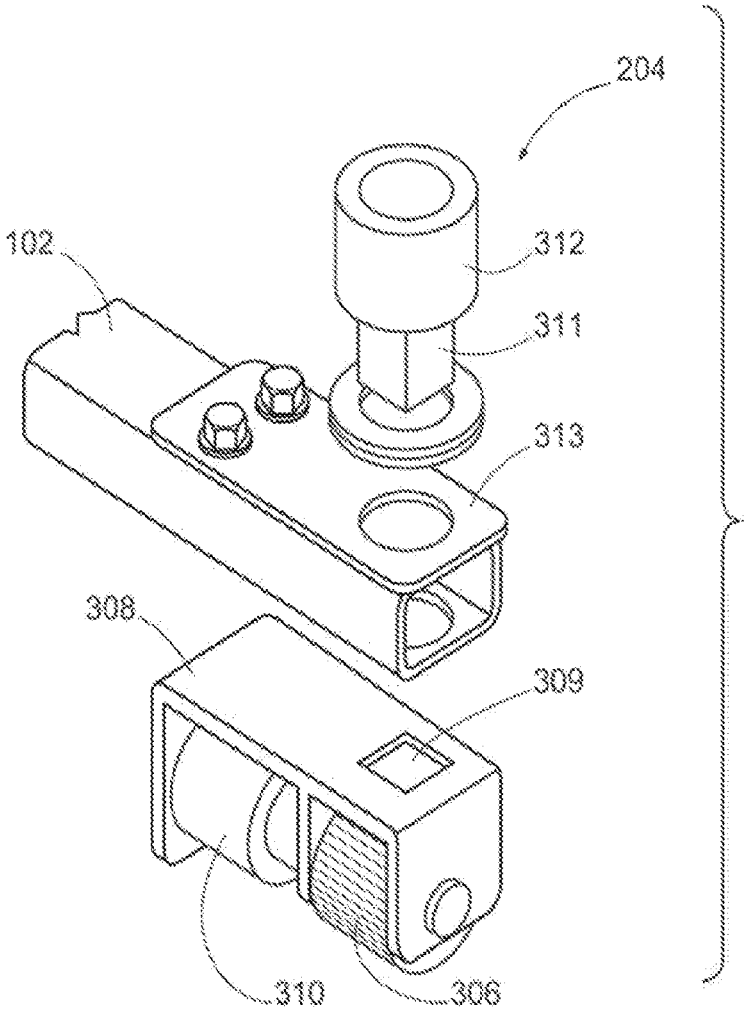
FIG. 11 is an exploded isometric view of the traversing apparatus shown in FIG. 10.

FIG. 10 is an enlarged isometric detail view taken at inset circle 10 in FIG. 9 of a single drive assembly of the alternate traversing device 204. Each device 204, seen more clearly in exploded isometric view FIG. 11, consists of a single splined drive wheel 306, journaled in a bifurcated bracket 308 and driven by a drive wheel motor 310. The bracket 308 can be suited with a square aperture 309 that telescopically receives a square lug 311 extending from a wheel assembly rotator 312. The rotator 312 can be fixed to a bracket 313 bolted to each end of the frame members 102. Drive wheel 306, and drive motor 310 are journaled in bracket 308 which form a unitary steerable wheel unit that may be selectively rotated by rotator 312 to drive the texturing device 200 in any desired direction.

Figure 12A:
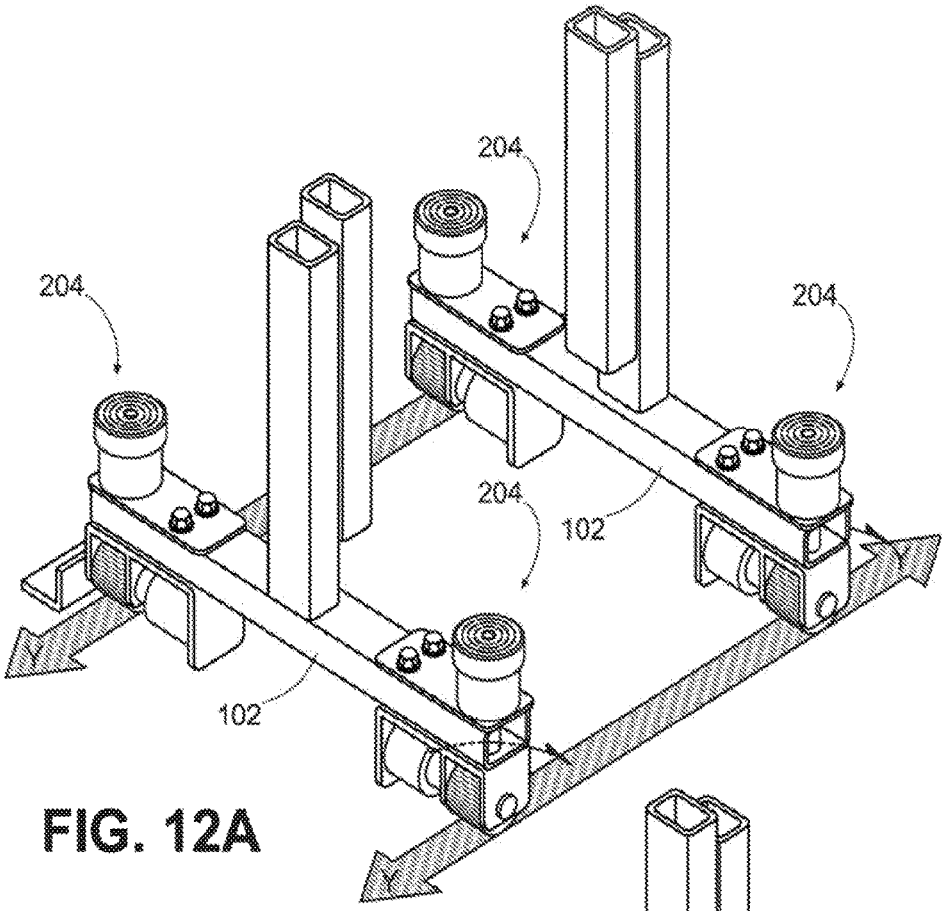
FIG. 12A is a diagrammatic isometric view showing a fragmentary portion of a lower portion of the frame suited with the frame traversing apparatus of FIGS. 10 and 11 traversing along the X plane.
Figure 12B:
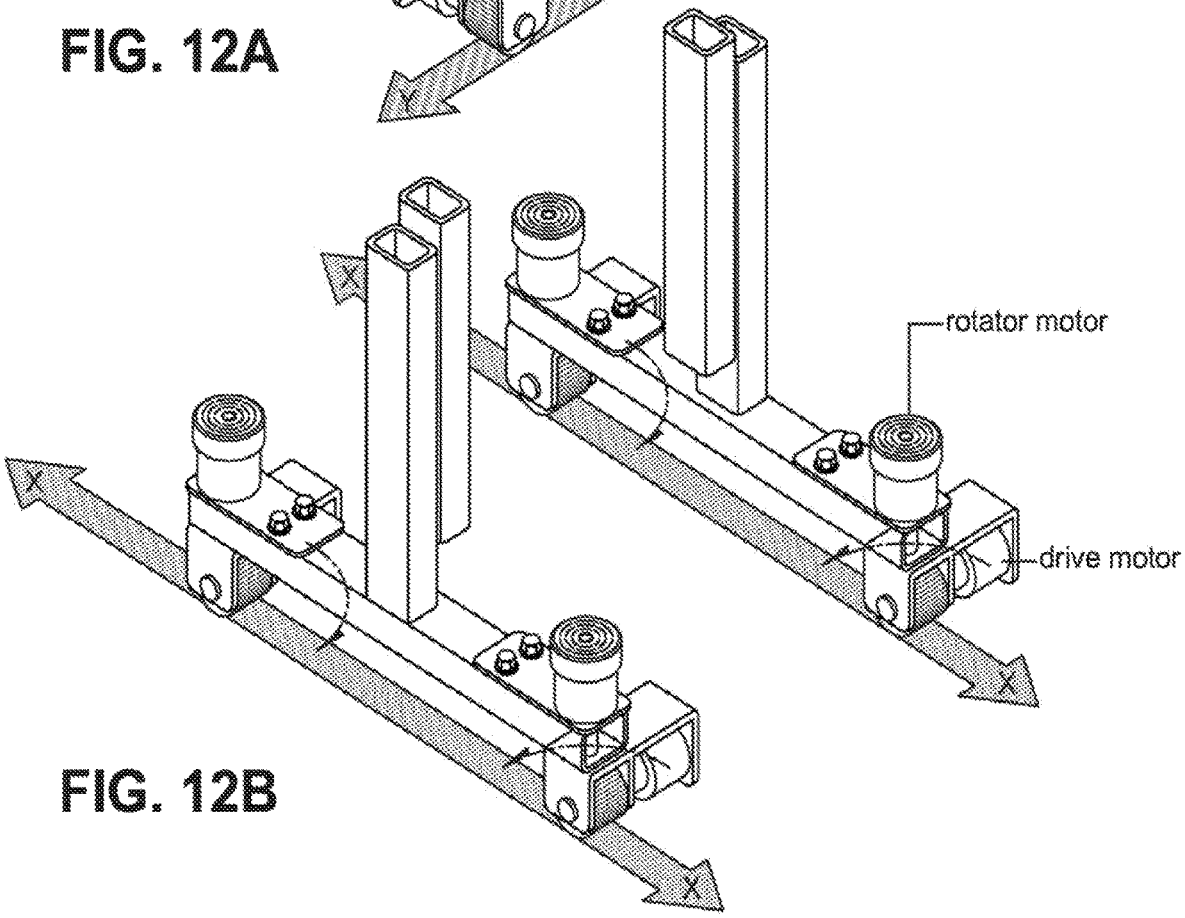
FIG. 12B is a diagrammatic isometric view, similar to FIG. 12A, and showing the traversing apparatus traversing along the X plane.

FIG. 12A shows the wheels 306 positioned to drive the texturing device 200 in the X direction, while FIG. 12B shows the drive wheels 306 rotated 90 degrees to drive the texturing device 200 in the Y direction.

Figure 13A:
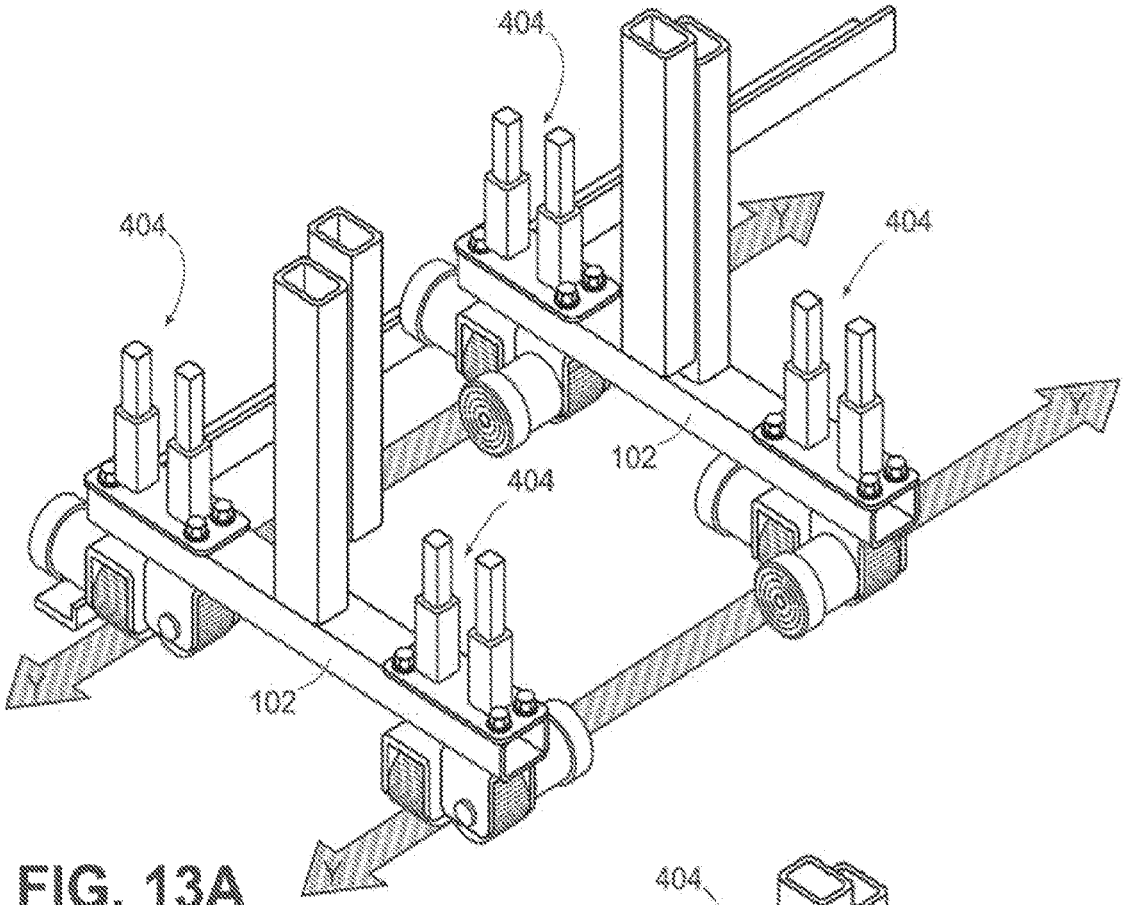
FIG. 13A is an isometric view showing a further alternate embodiment of the traversing apparatus and showing the drive wheels positioned to traverse the frame along the Y plane.
Figure 13B:
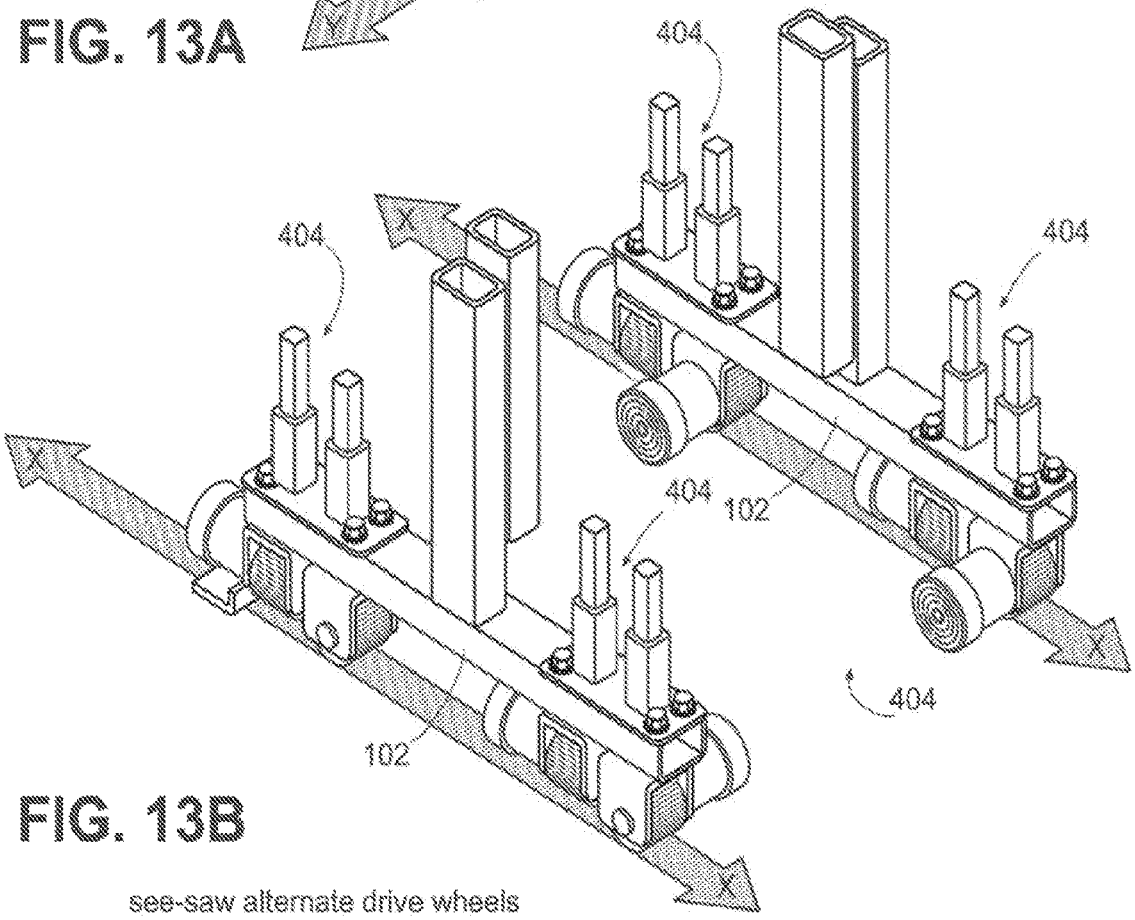
FIG. 13B is an isometric view, similar to FIG. 13A, and showing the drive wheels repositioned to traverse the frame along the X plane.
Figure 14:
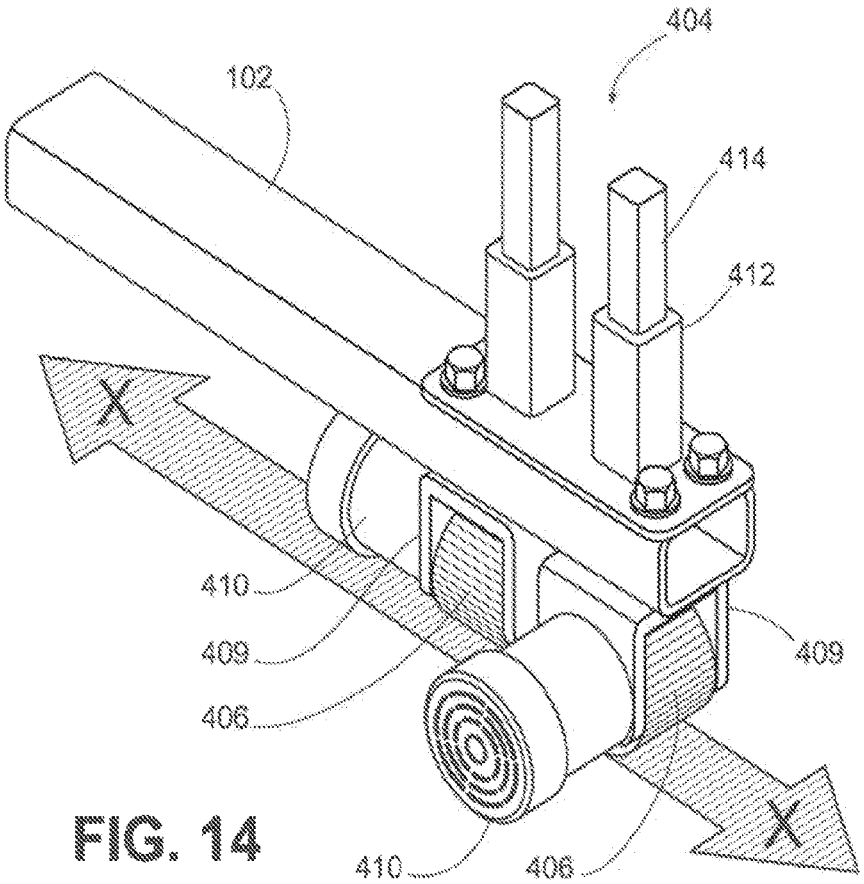
FIG. 14 is an enlarged fragmentary isometric view showing one traversing mechanism as seen in FIGS. 13A and 13B.
Figure 15A:
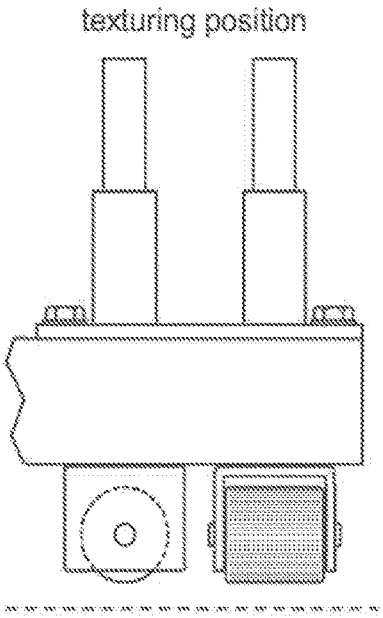
FIG. 15A is a side elevation view and shows both of the traversing wheels in a neutral position, raised and disengaged from the drive surface.
Figure 15B:
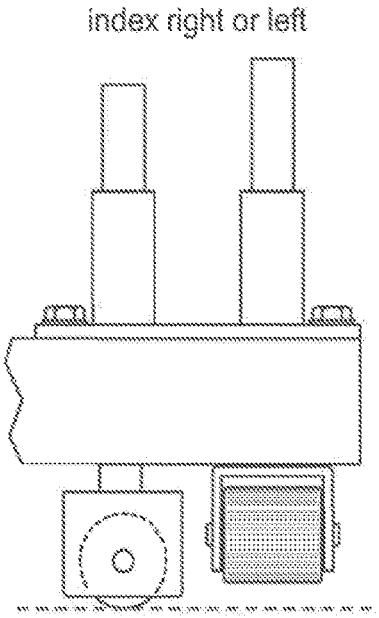
FIG. 15B is a side elevation, similar to FIG. 15A, and shows one of the two drive wheels lowered into engagement with the drive surface to traverse the texturing frame along the Y plane, as shown in FIG. 13A.
Figure 15C:
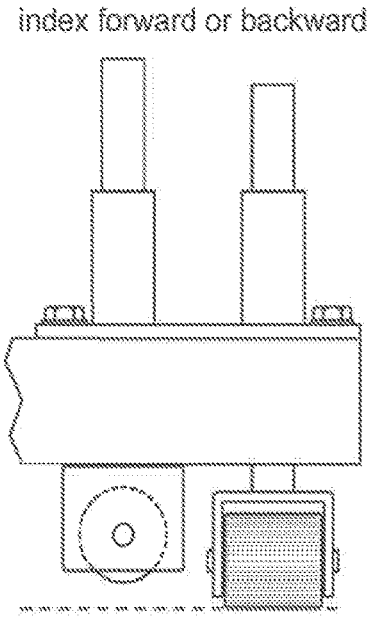
FIG. 15C is a side elevation, similar to FIGS. 15A and 5B, and shows the opposite drive wheel lowered into contact with the drive surface to traverse the texturing frame along the X plane, as illustrated in FIG. 13B.

FIG. 13A shows an alternate frame traversing wheel assembly set 404 positioned to drive the texturing frame 200 in the Y direction. Alternately, as seen in FIG. 13B the wheel assembly sets 404 can be repositioned to drive frame 200 in the X direction. The alternate drive wheel assemblies 404, and seen more clearly in FIG. 14, can consist of independently driven splined drive wheels 406, journaled within brackets 409 and driven by drive motors 410, providing longitudinal and transverse drive. Each independent wheel assembly may be energized to raise or lowered the wheels 406 via a linear actuator, servo motor, rodless cylinder, or the like 412 to raise or lower a telescopically received actuator member 414 fixed to each bracket 409, engaging or disengaging the drive wheels from the surface of pad P. FIG. 15A shows both drive wheels raised and disengaged with surface of pad P. FIG. 15B shows the wheels configured to drive the frame in the X direction, as shown in FIG. 14, and FIG. 15C shows the wheels configured to drive the frame in the Y direction. Thus, in an aspect the actuators 414 can be operated in a see-saw like manner to drive the frame in one direction (X) or in another direction (Y).

FIG. 16 is an isometric view of the carriage rotation device 160, which is better understood by viewing in combination with exploded isometric view, FIG. 17 showing a large sun gear 162 that is fixed to the vertically movable sub-frame 122 and axially connected to a rotation disc 164 via nut and axle bolt 166. The interior surface of disc 164 can be suited with a plurality half round elongated bearing seats 168 within which are seated a plurality of needle bearings 170. Disc 164 may also be detailed with grease fittings 172 to provide lubrication ports to the needle bearings in communication with the juxtaposed interior surfaces of gear 162 and rotation disc 164. The texture carriage 130 can be fixed to the rotation disc 164 whereby rotation of the disc 164 imparts rotation to the texturing carriage 130. A carriage rotation motor 174 can be fixed to the carriage 130 via a bracket or plate 175 attached to the carriage support arms 152, and the teeth of associated drive gear 176 engage the teeth of the sun gear 162 to rotate the carriage 130 in a clockwise or counter-clockwise direction around the sun gear 162 when motor 174 is energized. Understanding the function of carriage rotation can be seen in FIGS. 18A-18D, in which the carriage 130 is positioned at twelve o'clock, three o'clock, six o'clock and nine o'clock, respectively.

Figure 19:
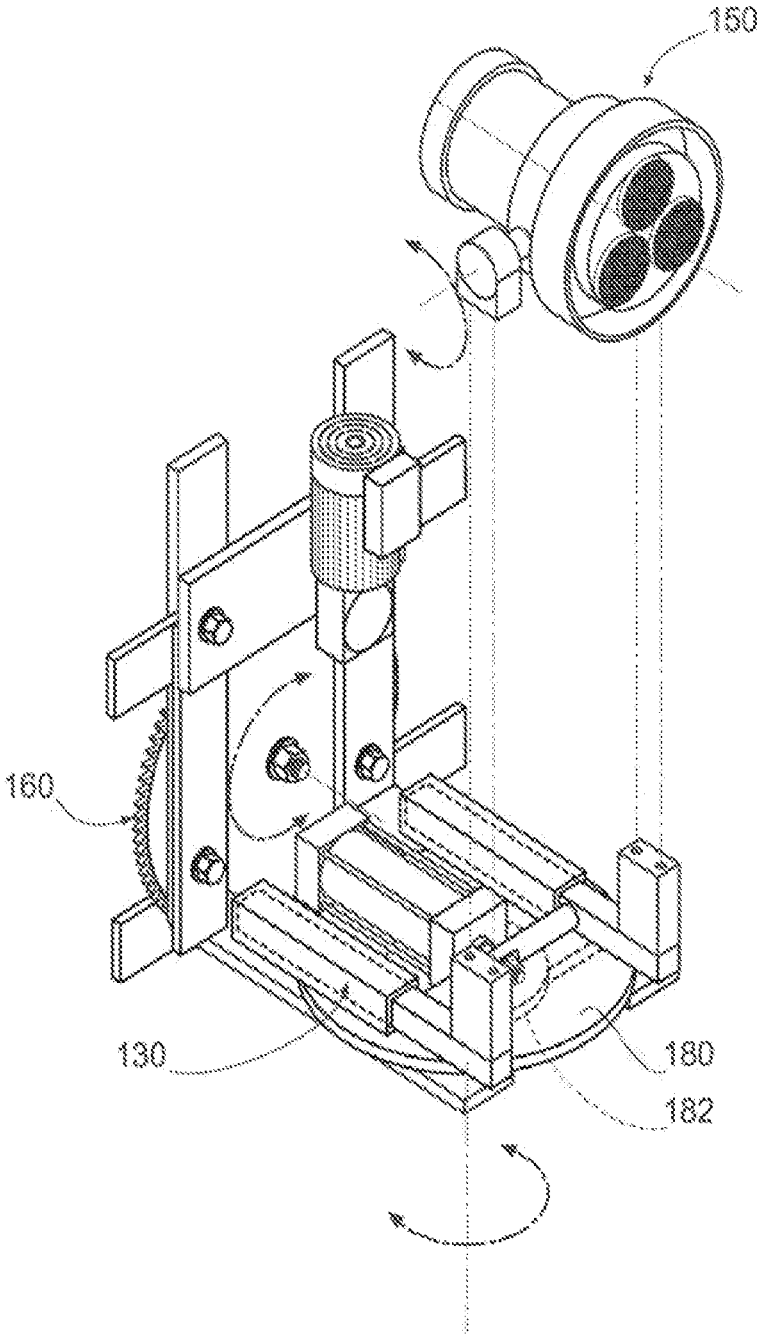
FIG. 19 is a partially exploded isometric view of an alternate embodiment of the texturing carriage.

An additional alternate embodiment is seen in FIG. 19, wherein the carriage 130 is mounted on a rotatable disc 180 and may be driven by an actuator motor 182, or the like, to rotate the carriage 130 on the axis of disc 180, providing horizontal and vertical head 150 rotation.

Figure 20C:
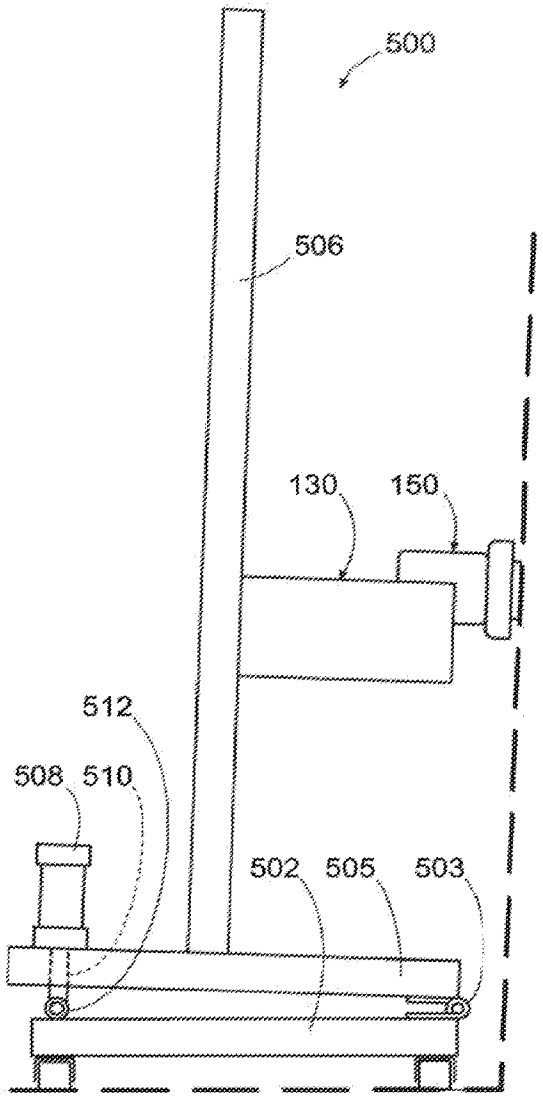
FIG. 20C is a schematic elevation view and shows the frame tilted forward with respect to the base.
Figure 20B:
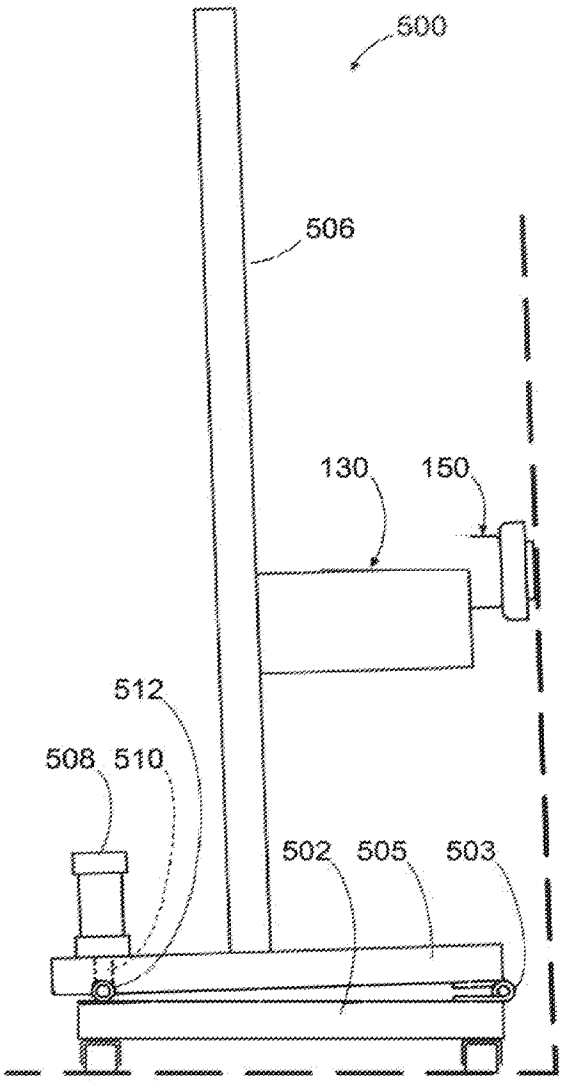
FIG. 20B is a schematic side elevation view, similar to FIG. 20A, and shows the frame tilted backward with respect to the base.
Figure 20A:
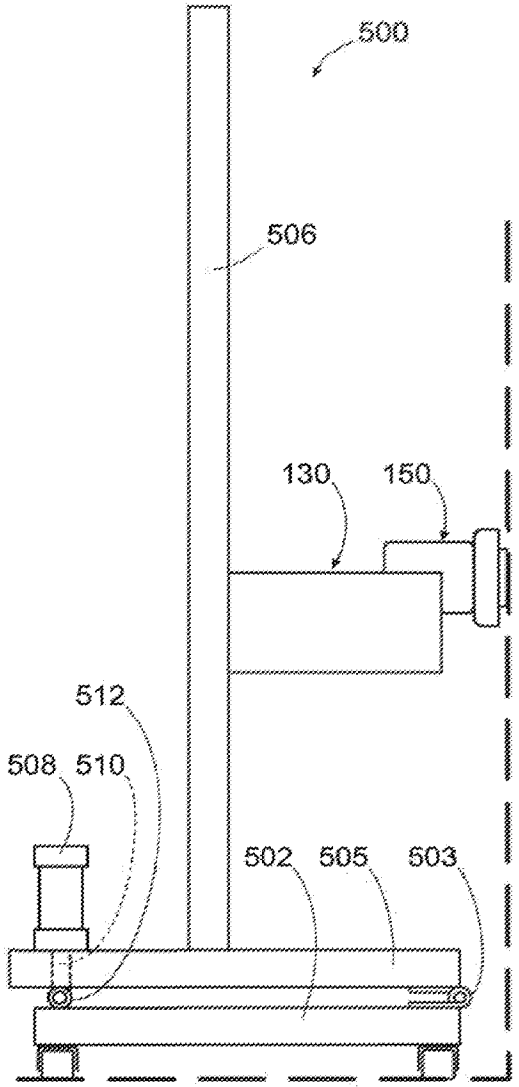
FIG. 20A is a schematic side elevation view showing an alternate embodiment of a tilt capable frame in an upright and vertical position.
Figure 21B:
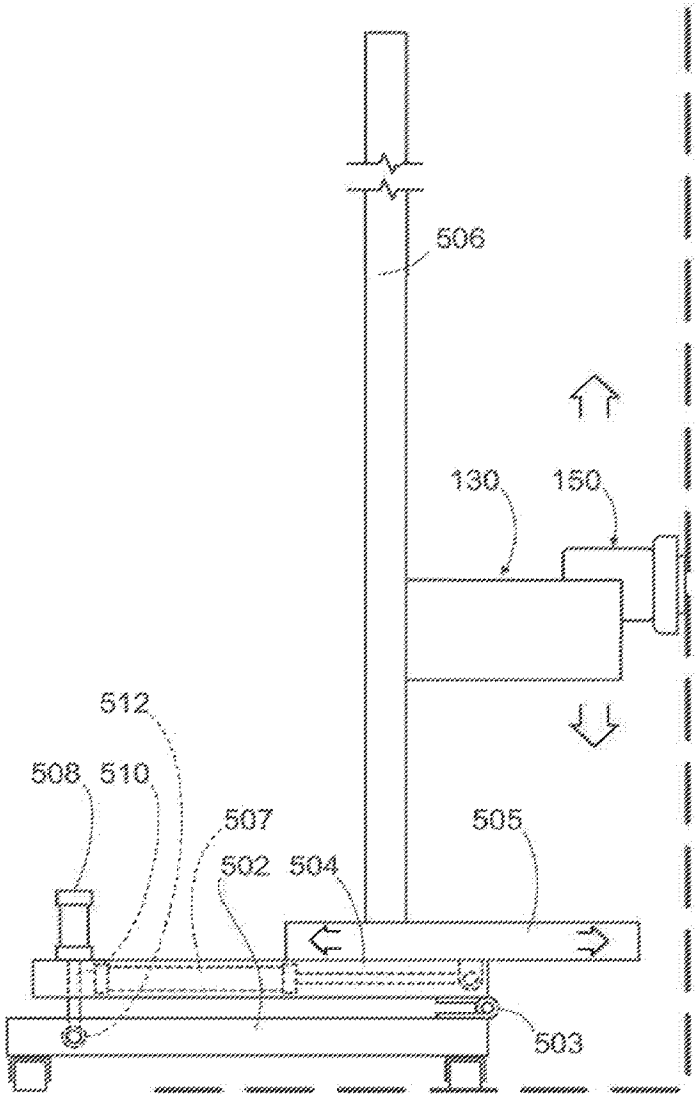
FIG. 21B is a schematic side elevation, similar to FIG. 21A and showing the upper frame advanced from the base.
Figure 21A:
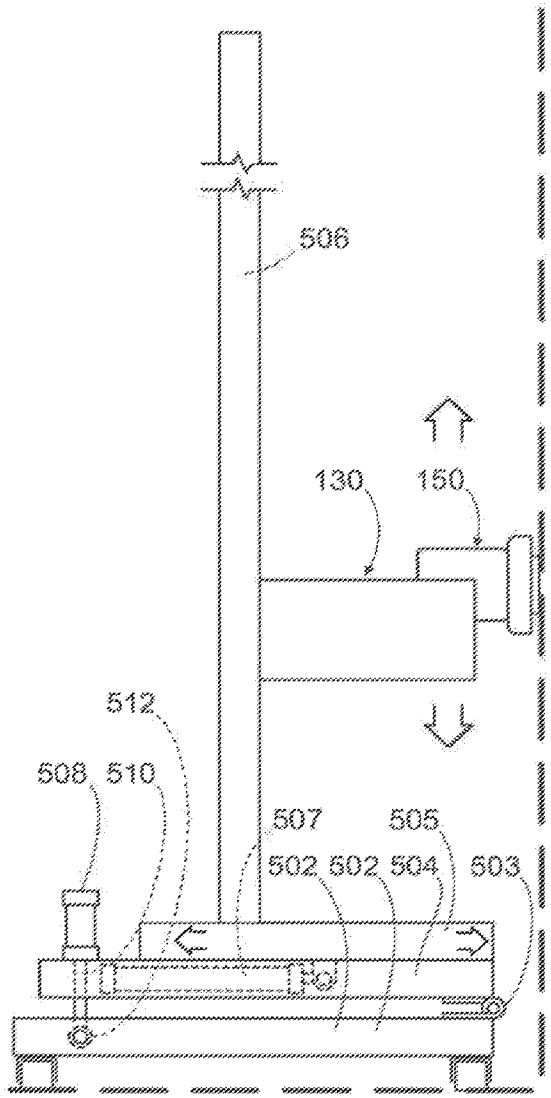
FIG. 21A is a schematic side elevation of a still further alternate embodiment, similar to FIGS. 20A-200 with the addition of a horizontal adjustment linkage apparatus between the base and upper frame.

FIGS. 20A-20C schematically show an alternate frame configuration 500, providing vertical/tilt adjustment, in which the base frame 502 is connected by a hinge 503 to an upper, substantially horizontal frame member 504 that is fixed to a substantially vertical frame member 506 forming a unitary "T" shaped composite upper frame. Opposite the hinge 503, on frame member 504 is attached a hydraulic cylinder or the like, 508, suited with a piston 510 having a roller 512 at its distal end. At an intermediate position of the piston 510, shown in FIG. 20A, the upper composite frame member, 506, is substantially vertical. As seen in FIG. 20B, the piston 510 can be retracted, causing the frame to tilt away from the wall W. Alternately, when piston 510 is extended, as in FIG. 20C, the frame can be tilted toward the wall W. FIGS. 21A-21B show an additional horizontal frame link 505 slidingly connected to frame member 504. The link 505 can be moved forward or backward by hydraulic cylinder or the like 507 to position the main frame toward or away from the surface to be textured, providing alternative transverse adjustment.

Figure 22:
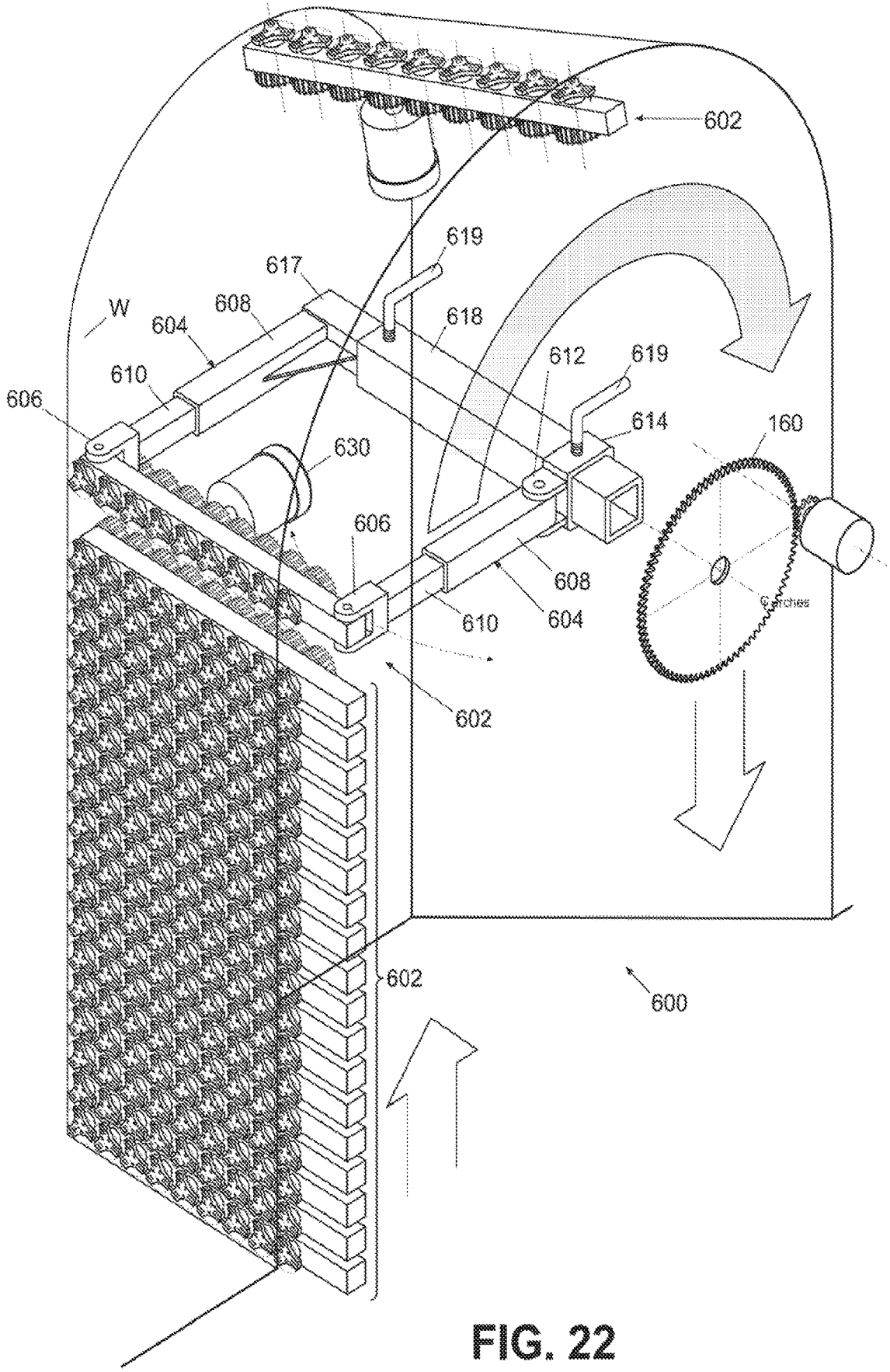
FIG. 22 is an isometric view showing a further alternate embodiment employing, generally, the previously disclosed frame in combination with a novel elongated multi bit texturing arm detailed to texture flat, arched, curved, concave or convex surfaces.
Figure 23:
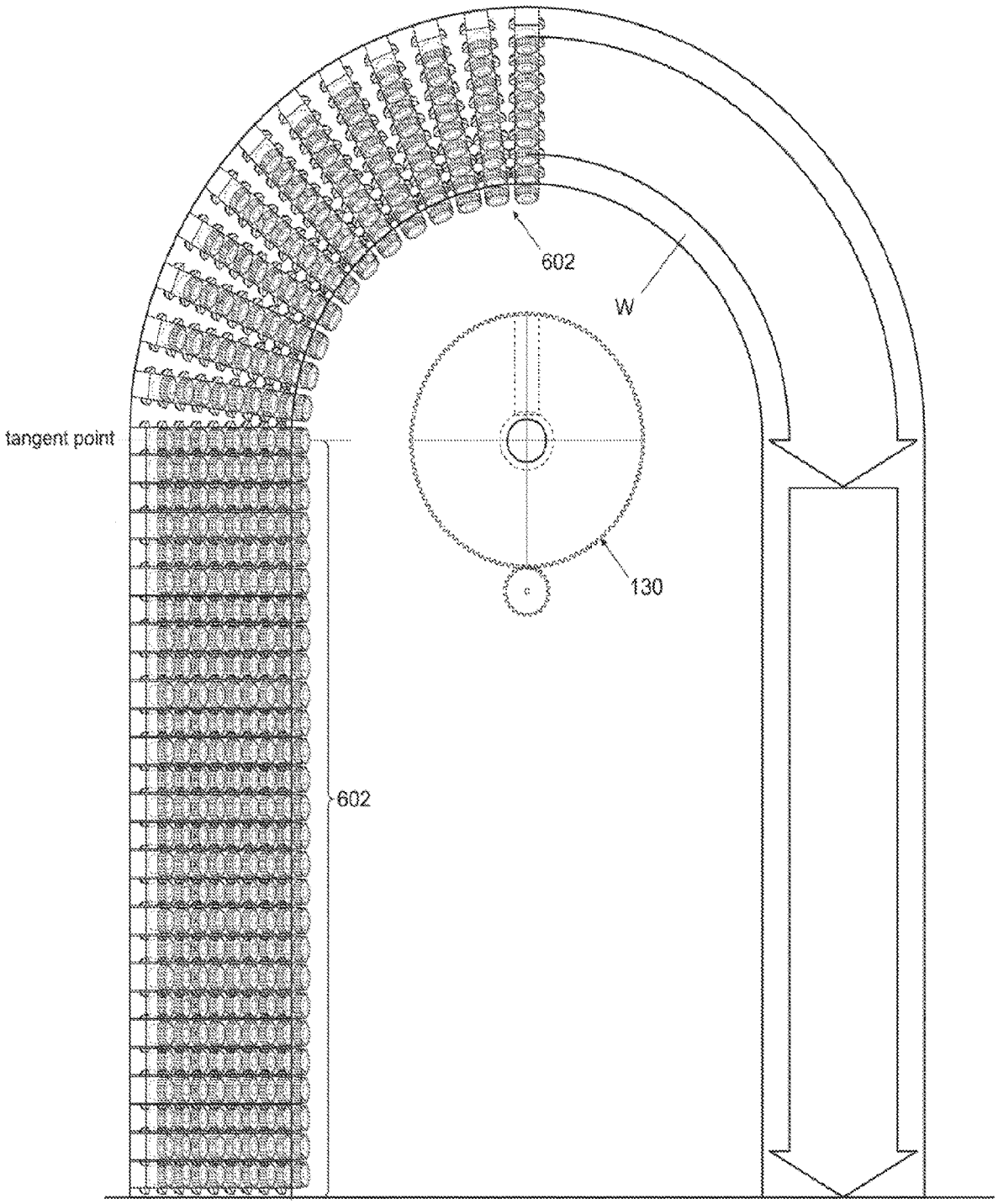
FIG. 23 is a front elevation of the embodiment shown in FIG. 22.
Figure 24:
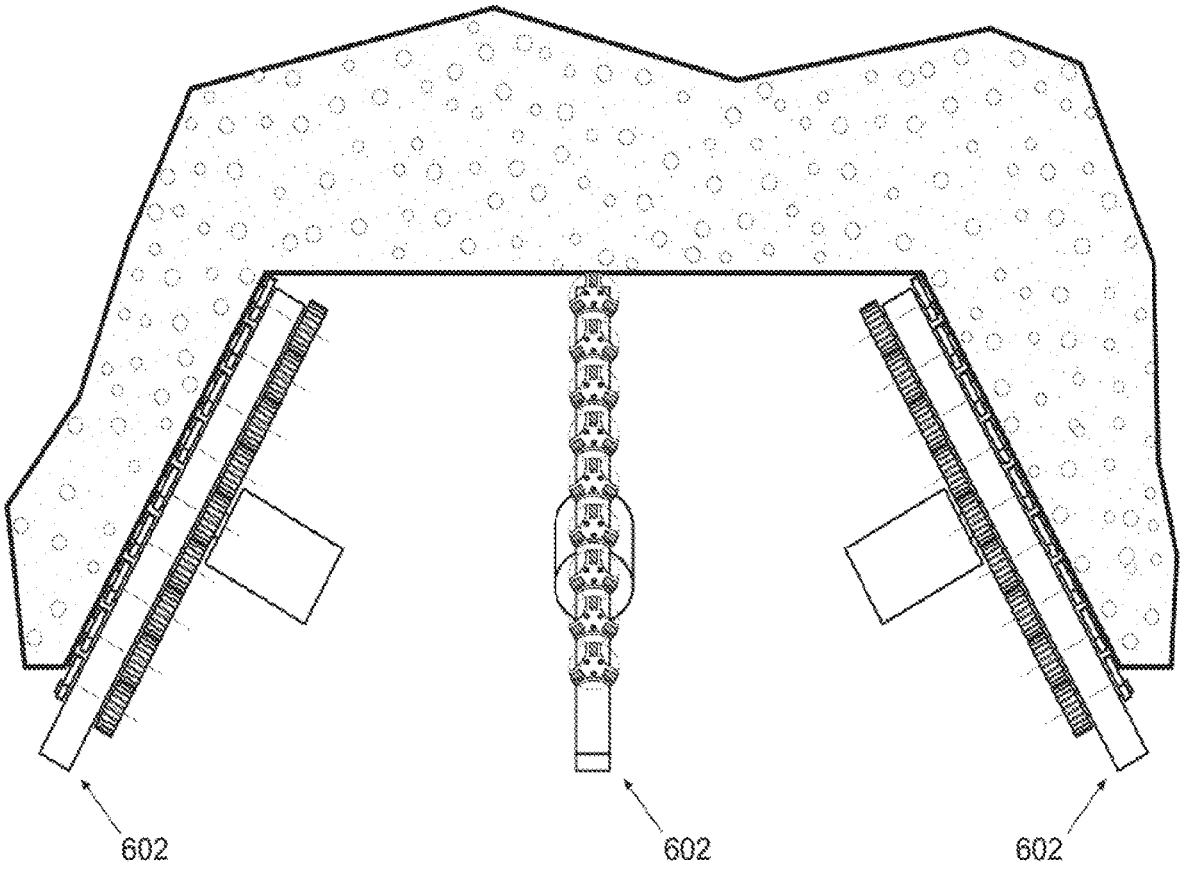
FIG. 24 is cross-sectional top plan view of the embodiments illustrated in FIGS. 22 and 23.

FIG. 22 is an isometric view showing a further alternate embodiment, of a texturing device 600 sans the previously described texturing carriage, and in its place can be one or more linear texturing or polishing arms 602. As depicted, there is only one polishing arm 602 associated with the texturing device 600, but FIG. 22 shows successive positions of the arm along a wall W as it moves up to a tangent point that transcends into an arch. The polishing arm 602 can be supported by a pair of telescoping arms 604, attached by yokes 606 to each end of the arm 602. Arms 604 can consist of an outer sleeve 608 and telescopically receive a piston arm 610, capable of urging the polishing arm 602 against the surface of a wall W. The shaft 608 can be attached by yokes 612 to rectangular stub sleeves 614, which telescopically surrounds a linear drive and rotation shaft 618, attached to the rotation device 160. The stub sleeve may be suited with an angled setscrew 619 to selectively lock the sleeve to shaft 618. The distal end of shaft 618 can telescopically receive an inner shaft 617 that may be locked to outer shaft 614 by a similar angled set screw 619. Shaft 617 can be fixed to the shaft 608 that receives a tubular shaft 610, which is attached to distal end of the arm 602. Fixed at a mid-point on polishing arm 602 is a drive motor 630 (motor mounts not shown for clarity). FIG. 23 is a front elevation of the texturing device 600 shown in FIG. 22, and FIG. 24 is a transverse cross-section showing the texturing device 600.

Figure 25:
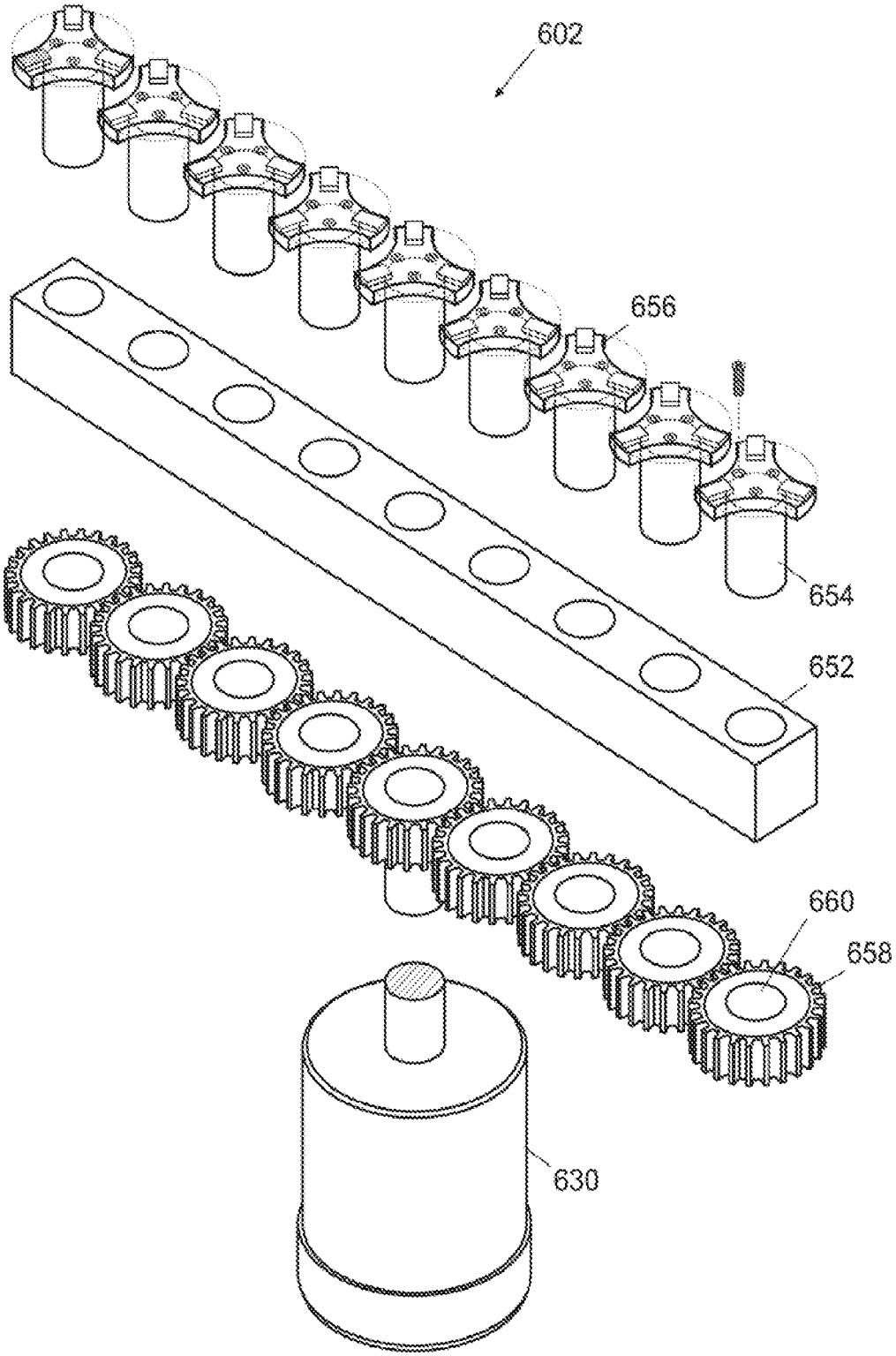
FIG. 25 is an exploded isometric view of the multi bit texturing arm.

FIG. 25 is an exploded isometric view of the texturing arm assembly 602 consisting of an elongated mounting block 650 having a plurality of apertures 652 to telescopically receive the drive shafts 654 of texturing bit assemblies 656. Texturing bit assemblies are suited with a set of grinding, texturing or polishing bits 657 attached to the outer periphery of substantially triangular shaped bit mounting plates 659. Opposite the bit assemblies 656, on mounting arm 650 are a plurality of drive gears 658, having apertures 658A to receive the drive shafts 654 of the bit assemblies 656. Each gear 658 may be mechanically attached to its associated drive shaft 654 by a setscrew (not shown) or other such fasteners. The gears can be driven by a drive motor 670, which is rigidly attached to the mounting block via a motor mount (not shown).

Figure 26:
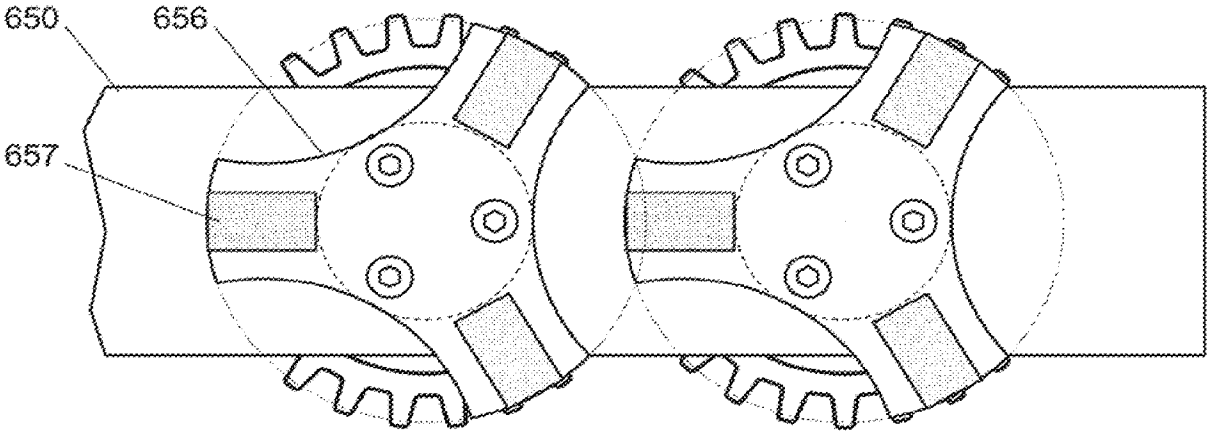
FIG. 26 is a bottom plan view illustrating a fragmentary portion of the texturing arm shown in FIG. 25.
Figure 27:
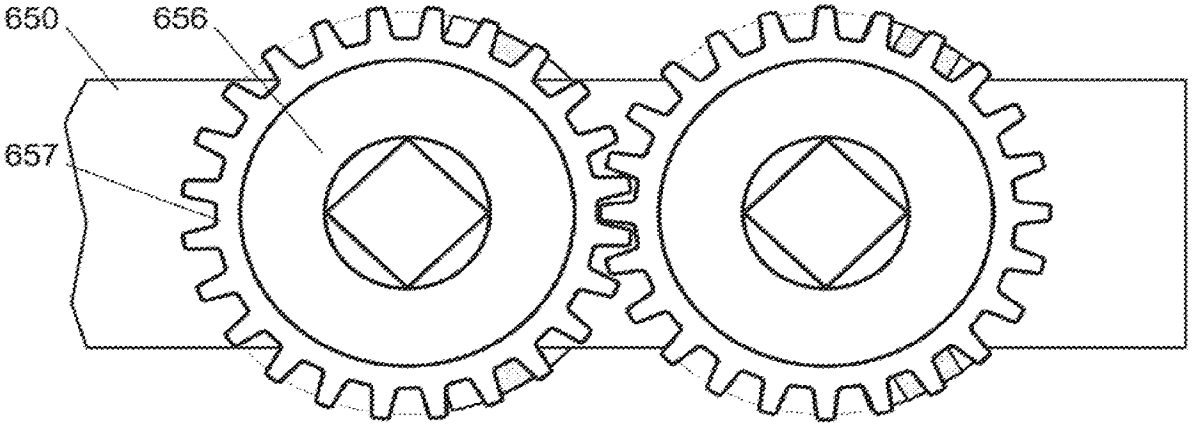
FIG. 27 is a top plan view, opposite the plan view illustrated in FIG. 26 and showing a plurality of texturing bits.
Figure 28:
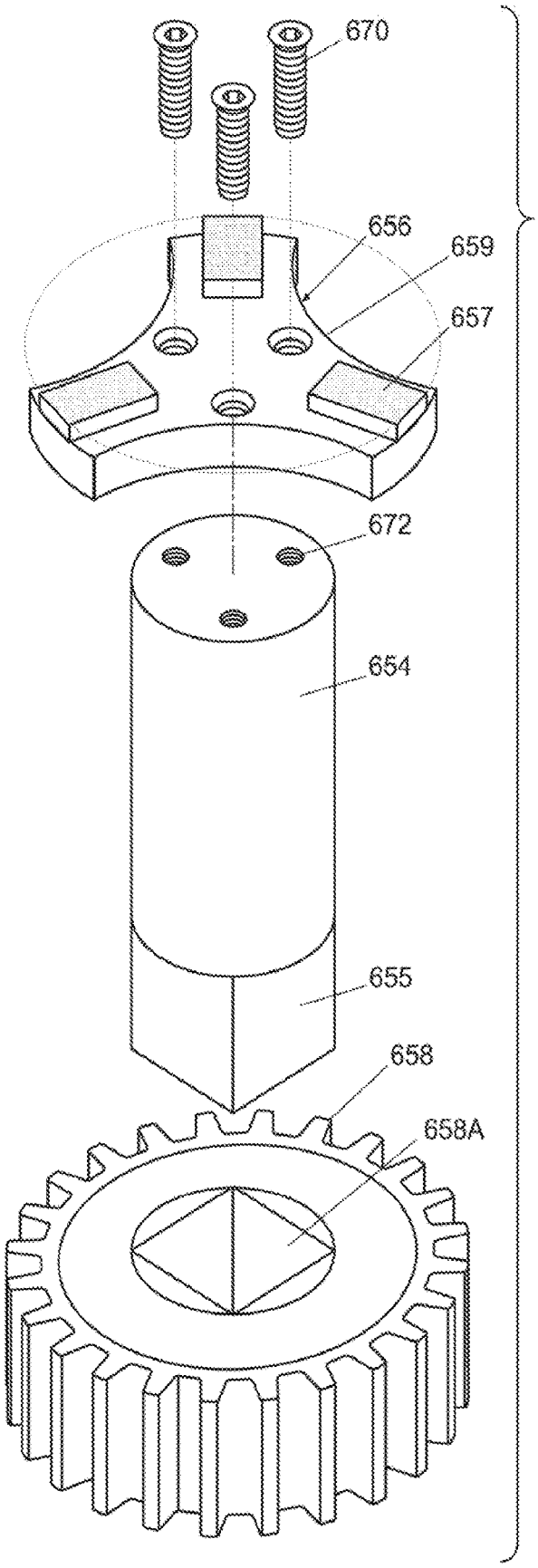
FIG. 28 is an exploded isometric view of the combination of a texturing bit assembly, and its associated drive shaft and gear.
Figure 29:
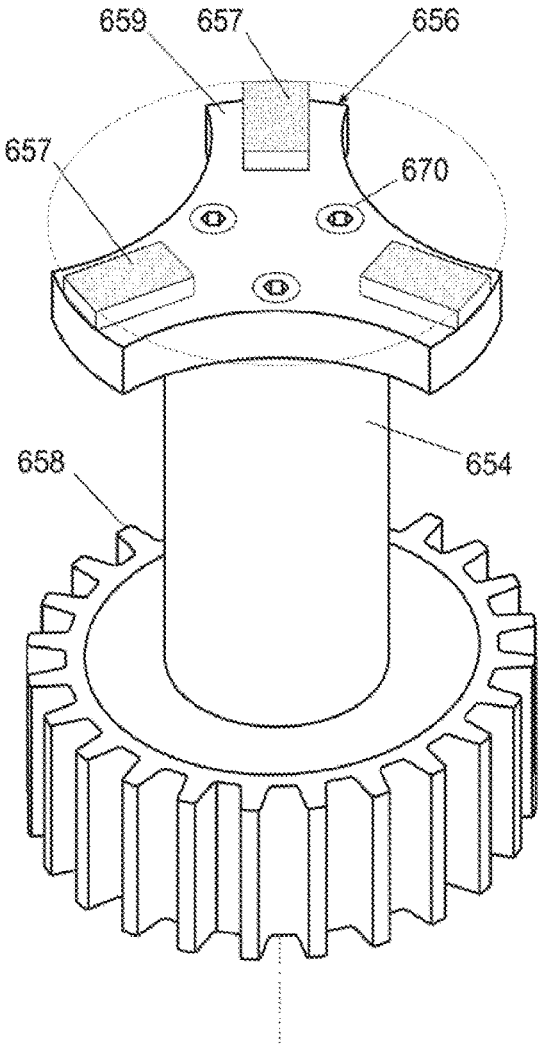
FIG. 29 is an isometric view if the apparatus of FIG. 28 in situ.

FIGS. 26 and 27 are plan views of a fragmentary portion of texturing arm assembly showing the bit assembly 656 plan and gear 658 plan, respectively. FIG. 28 illustrates an exploded isometric view of a texturing bit 656, disposed from its drive shaft 654, and secured by screws 672 into threaded bores 672A in the drive shaft 654. Drive shafts 654 are detailed with square lugs 655 that are telescopically received by matching square apertures 658A in gear 658 and secured thereto by securing means (not shown). FIG. 29 shows the elements of FIG. 28 in situ.

Figure 30:
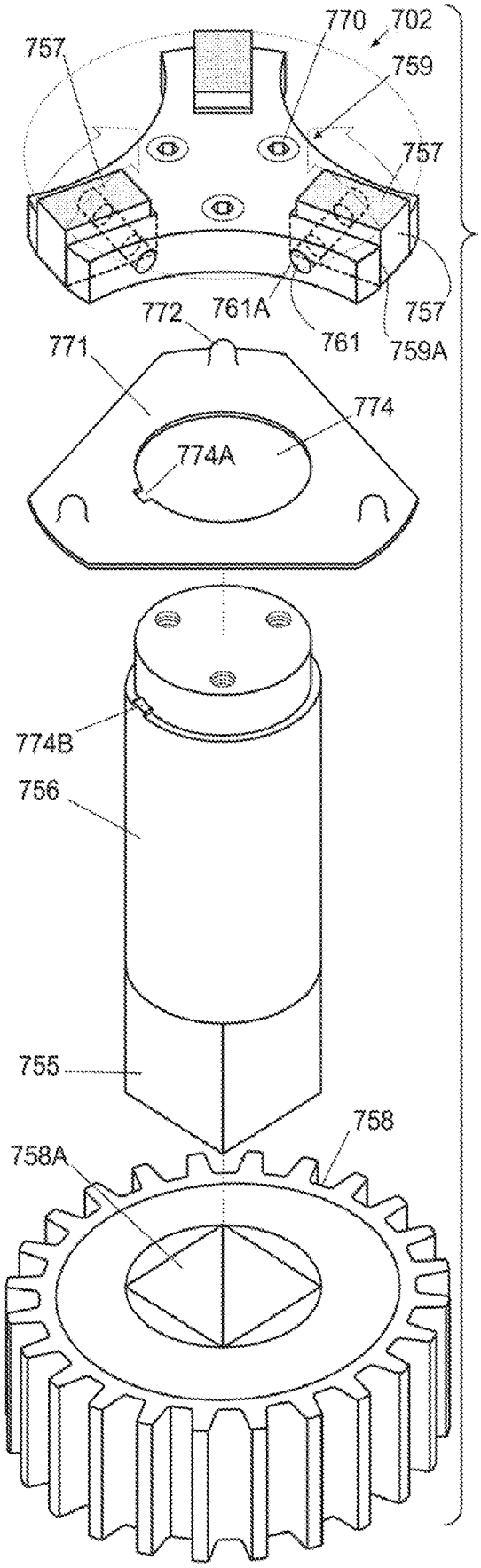
FIG. 30 is an exploded isometric view and shows an alternate embodiment of a bit in a bit assembly wherein the individual bits are detailed to rotate within the bit holder in order to accommodate and adapt to a convex curved surface.
Figure 31:
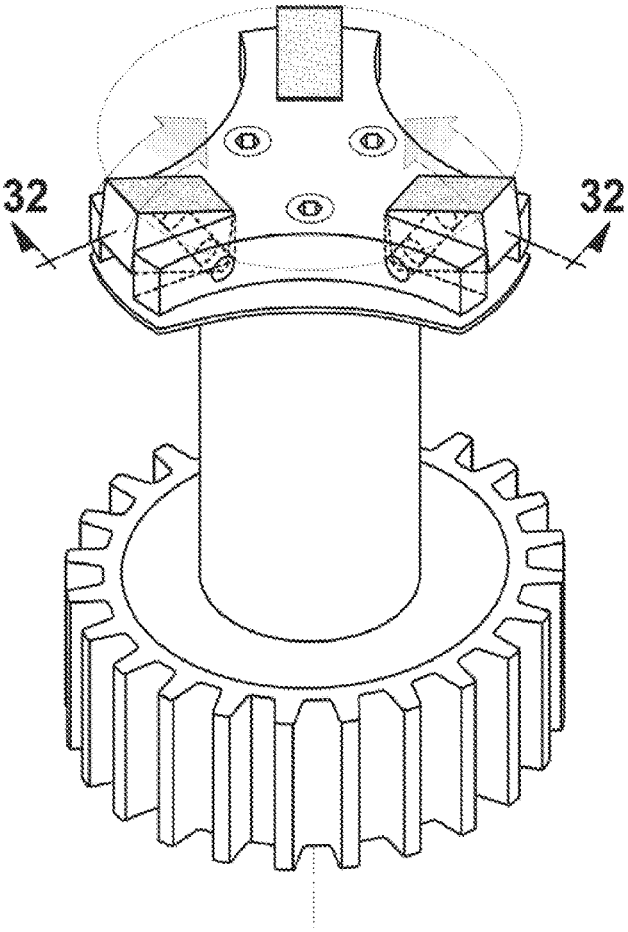
FIG. 31 is an isometric view and illustrates the bit assembly shown in FIG. 30 in situ.

FIG. 30 is an exploded isometric view showing an alternate embodiment of a texturing bit assembly 702 (FIG. 31) with articulated spring loaded bits, to be explained in the foregoing disclosure. The bit mounting plates 759 are suited with open slots 759A at their peripheral distal ends to accommodate articulated bit mounting segments 757. The bit mounting segments 757 are suited with apertures to receive pivot axles 761 that are journaled in apertures 761A in the bit mounting plates 759. Disposed below the compound articulated bit assembly 702 is a triangular leaf spring 771 suited with protrusions 772 to about a juxtaposed lower surface of each bit mounting segment 757. The leaf springs are detailed with an aperture 774 that telescopically receive an upper segment of the shaft 756. This segment can be suited with a key 774B that receives a keyway 774A to rotationally fix the position of the spring 771 and secure it to the drive shaft 756. The shaft can be suited with a lug 755 that is received in opening 758A of the gear 758.

Figure 32:
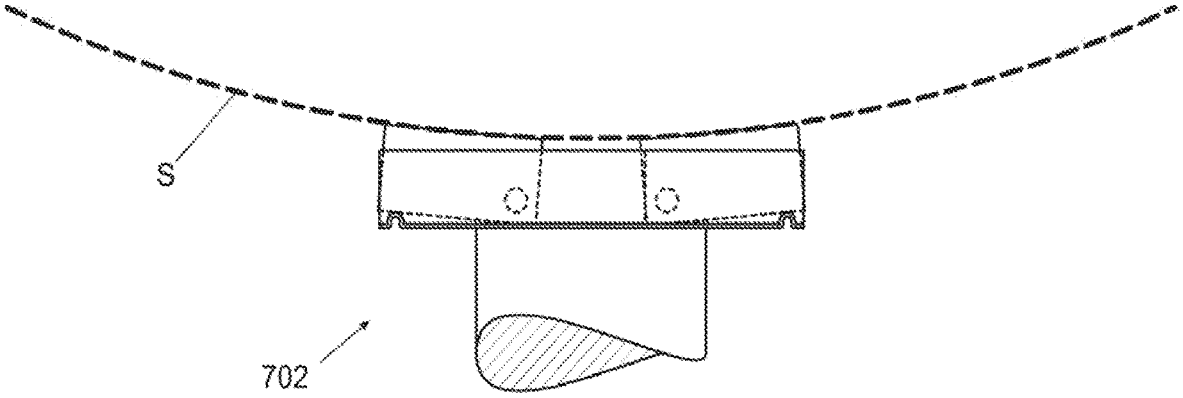
FIG. 32 is a diagrammatic side elevation, taken along lines 32-32 in FIG. 31, illustrating the bit assembly of FIGS. 30 and 31 in contact with a convex aggregate surface to be textured.
Figure 33:
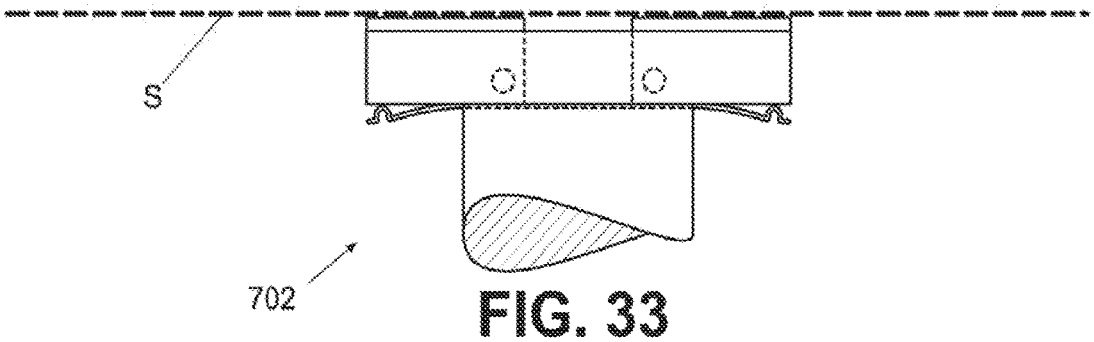
FIG. 33 is a diagrammatic side elevation illustrating the bit assembly of FIGS. 30 and 31 in contact with a substantially flat surface to be textured.
Figure 34:
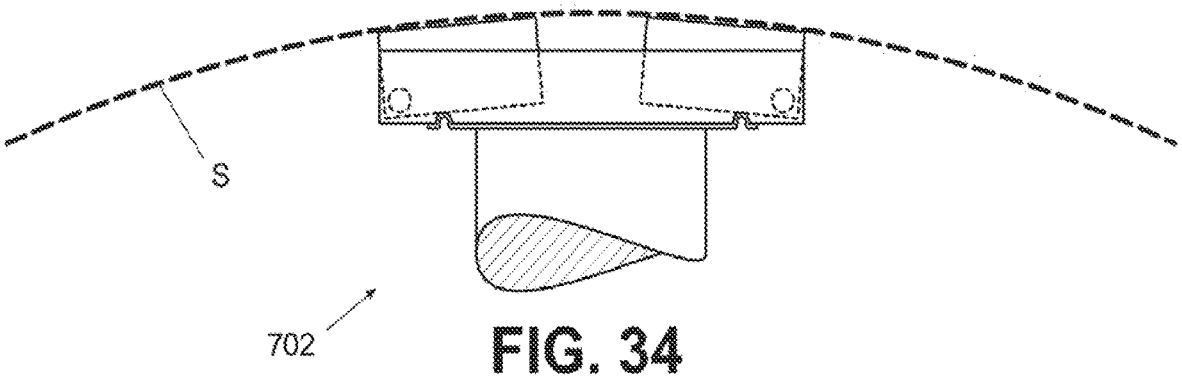
FIG. 34 is a diagrammatic side elevation illustrating the bit assembly of FIGS. 30 and 31 in contact with a concave curved surface.

Shown in FIG. 32 is the articulated, and spring-loaded bit 702 in contact with the convex surface S of a wall segment. FIG. 33 is a view, similar to FIG. 32, and shows the bit 702 in contact with the flat surface S of a wall segment. FIG. 34 is a similar view showing the bit 702 in contact with a concave surface S of a wall segment.

Figure 35:
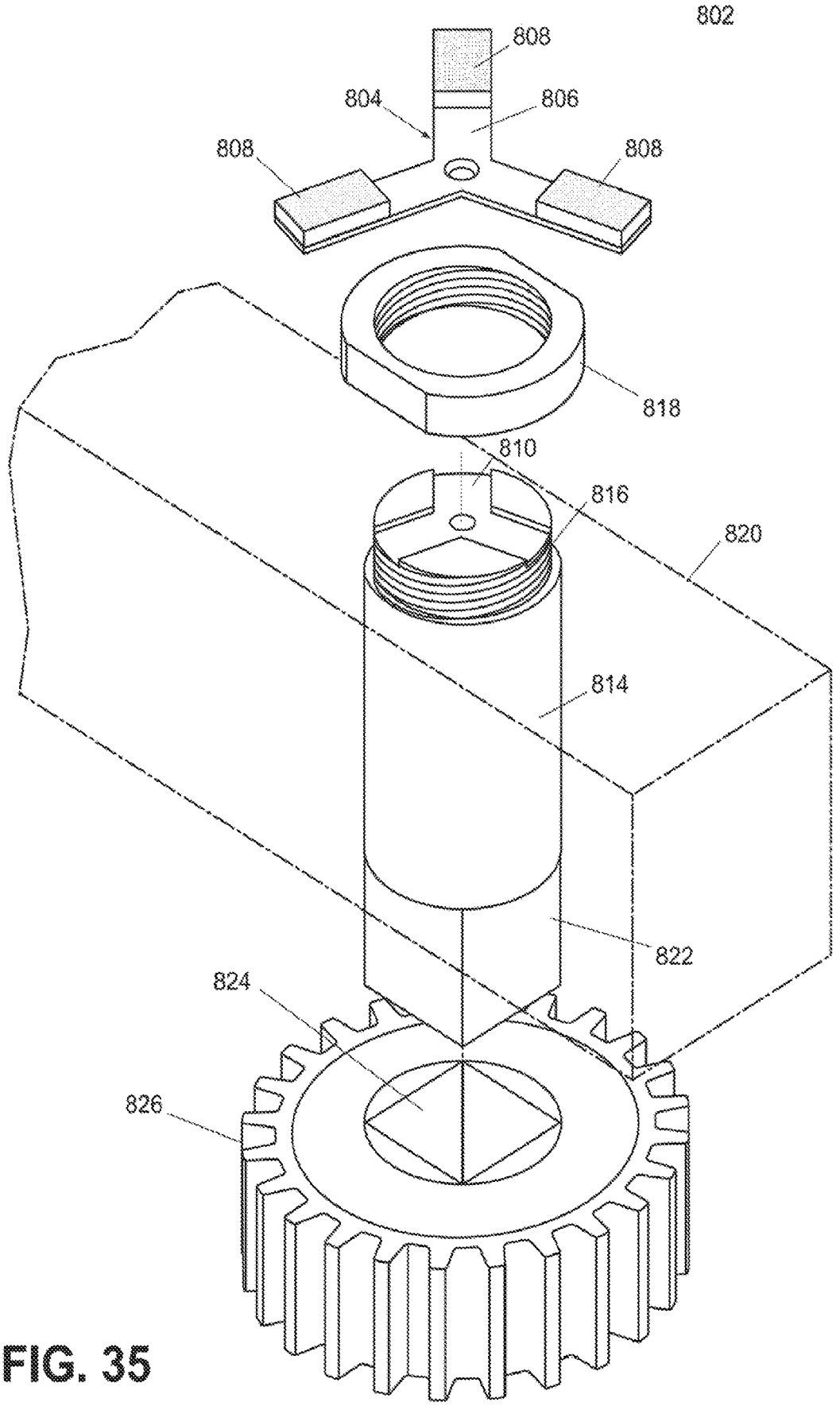
FIG. 35 is an exploded isometric view showing an alternate embodiment of a novel bit assembly.
Figure 36:
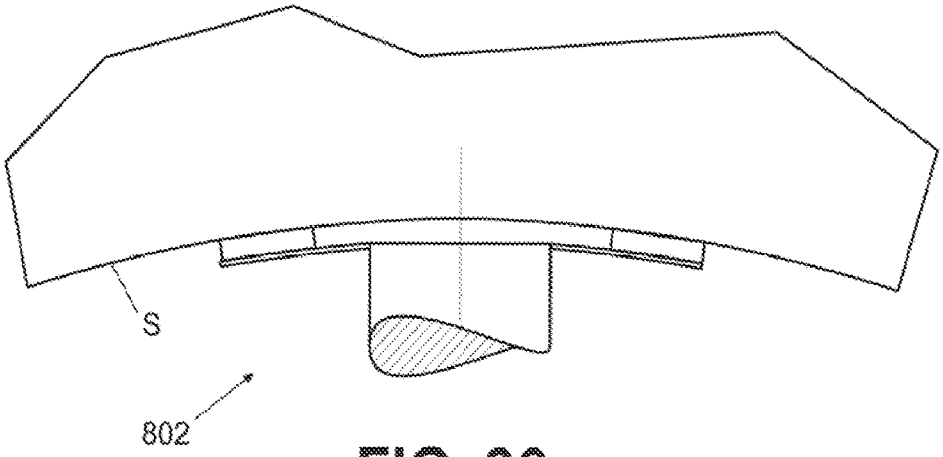
FIG. 36 is a diagrammatic side elevation and showing the bit illustrated in FIG. 35 in contact with a concave curved surface.
Figure 37:
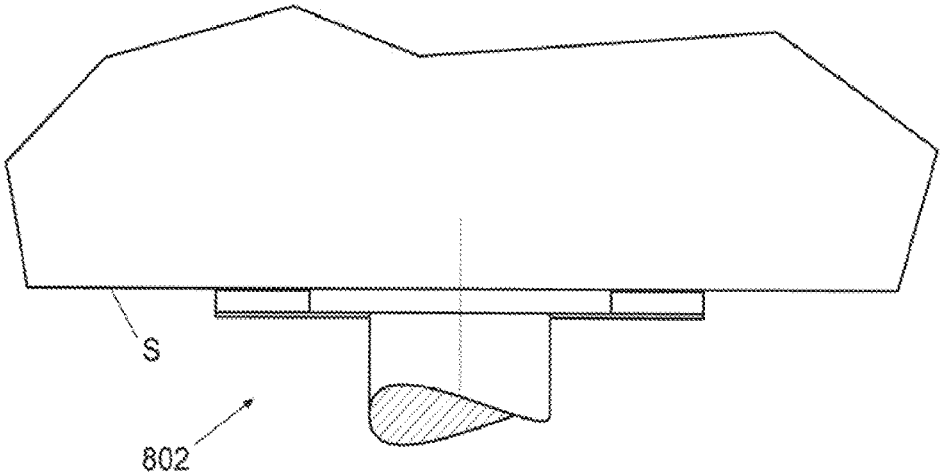
FIG. 37 is a diagrammatic side elevation and showing the bit illustrated in FIGS. 30 and 31 in contact with a substantially flat surface.
Figure 38:
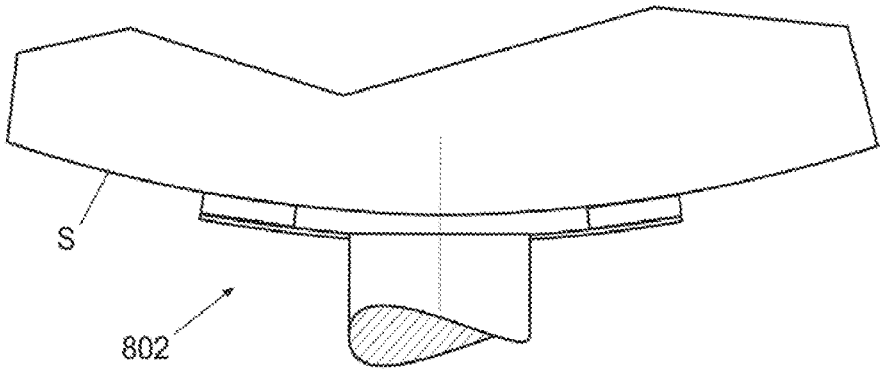
FIG. 38 is a final diagrammatic side elevation of the bit illustrated in FIGS. 30 and 31 in contact with a convex curved surface.

FIG. 35 is an exploded isometric view of a further alternate embodiment of a grinding, polishing bit assembly 802. The bit assembly can consist of a triangulated spring 804 having segments 806 (such as three segments), each, suited with fixed grinding bits 808 at the peripheral ends of each spring segment 806. The spring 804 is received within a triangular recess 810 on the upper end surface of a drive shaft 814 and secured thereto with a screw, not shown. Upper end of shaft 814 can be suited with a reduced threaded neck portion 816 that receives an internally threaded bezel 818 suited with wrench flats to capture the shaft for rotation within the texturing arm 820. The shaft 814 can be suited with a lug 822 that is telescopically received in a complimentary opening 824 in a drive gear 826. FIG. 36 is a schematic representation of the bit assembly 802 in contact with a concave surface S. FIG. 37 is a similar view and showing the bit assembly 802 in contact with a flat surface S. FIG. 38 shows the bit assembly 802 in contact with a convex surface S.

While the present disclosure has been described in connection with certain embodiments, it is to be understood that the subject matter encompassed by way of the present disclosure is not to be limited to those specific embodiments. On the contrary, it is intended for the subject matter of the disclosure to include all alternatives, modifications, and equivalents as can be understood by one of ordinary skill in the art.

Therefore, the following is claimed:

1. An apparatus, comprising:

a texturing carriage;

a carriage rotation device coupled to the texturing carriage and configured to rotate the texturing carriage;

a vertical frame member including a vertical guide member configured to guide the texturing carriage or the carriage rotation device, or both, in a vertical direction in relation to a surface on which the apparatus rests; and a traversing device, the traversing device configured to move the apparatus along the surface on which the apparatus rests.

2. The apparatus of claim 1, wherein the traversing device is configured to move the apparatus along the surface on which the apparatus rests in a direction substantially perpendicular to a vertical work surface.

3. The apparatus of claim 1, including a horizontal frame member supporting the vertical frame member, the traversing device attached to the horizontal frame member.

4. The apparatus of claim 1, wherein the carriage rotation device is configured to rotate the texturing carriage about an axis substantially perpendicular to a vertical work surface or substantially parallel to the surface on which the apparatus rests, or both.

5. The apparatus of claim 1, wherein the texturing carriage is configured to be maintained horizontally disposed in the apparatus in relation to the surface on which the apparatus rests, or substantially perpendicularly disposed in the apparatus in relation to a vertical work surface, or both.

6. The apparatus of claim 1, wherein the traversing device comprises:

a first drive motor; and a first drive wheel, the first drive wheel configured to move the horizontal base frame member in a first direction, and wherein the traversing device optionally comprises:

a second drive motor; and a second drive wheel, the second drive wheel configured to move the horizontal base frame member in a second direction perpendicular to the first direction.

7. The apparatus of claim 6, wherein the apparatus includes a horizontal frame member supporting the vertical frame member, the traversing device attached to the horizontal frame member, and the first drive wheel or the second drive wheel are attached to the horizontal base frame member.

8. The apparatus of claim 1, wherein the traversing device further comprises a guide roller configured to engage a track.

9. The apparatus of claim 6, wherein the traversing device further comprises a guide roller configured to engage a track, the track positioned in the first direction, the apparatus optionally including a base pad and wherein the traversing device further comprises a guide roller configured to engage a track, the track mounted to the base pad.

10. The apparatus of claim 1, wherein the traversing device comprises:

a wheel rotator, optionally having a lug;

a drive wheel, optionally journaled in a bracket comprising an aperture configured to receive the optional lug of the wheel rotator; and a drive motor, optionally journaled in a bracket, and configured to drive the drive wheel forming a steerable wheel unit configured to be selectively rotated by the wheel rotator.

11. The apparatus of claim 1, wherein the texturing carriage comprises a texturing head configured to hold one or more texturing pads and a texturing head motor, the texturing head motor configured to move the one or more texturing pads across a work surface and wherein the texturing carriage is configured to extend and retract the texturing head towards and away from the work surface, and wherein the texturing head is mounted to the texturing carriage and the texturing head is configured to be pivoted about the texturing carriage between a position wherein the texturing pads engage a vertical work surface and wherein the texturing pads engage a horizontal work surface, optionally wherein the texturing carriage comprises:

a cradle to which the texturing head is connected; and means for extending and retracting the cradle, and thereby the texturing head, towards and away from a work surface.

12. The apparatus of claim 1, wherein the texturing carriage comprises:

a pair of pillow blocks positioned on a pair of opposed posts, the pillow blocks configured to journal the texturing head to provide pivotal connection of the texturing head to the cradle, each post upstanding at a distal end of a pair of slidable guide arms;

the cradle comprising one or more guide rollers, the guide rollers rotatably fixed to the cradle; and a means for extending and retracting the cradle including a pneumatic cylinder fixed to the cradle and connected to a connector dowel via a piston rod, the connector dowel fixed to the slidable guide arms and configured to provide unitary movement of the guide arms.

13. The apparatus of claim 1, wherein the texturing carriage is connected to one or more slidable guide arms via rotators fixed at distal ends of one or more slidable guide arms, each rotator having a rotation portion and an non-rotating portion, the rotation portion being a radial rotation portion configured to rotate the texturing head to a radial position.

14. The apparatus of claim 1, wherein the texturing carriage comprises:

a linear texturing arm;

one or more telescoping arms configured to support the linear texturing arm, each telescoping arm having a piston arm, the piston arm configured to urge the linear texturing arm against a surface to be textured;

the one or more telescoping arms attached to a rotation shaft configured to attach to the carriage rotation device.

15. The apparatus of claim 14, wherein the linear texturing arm comprises an elongated mounting bar having a plurality of apertures, the apertures configured to receive drive shafts from a plurality of texturing bit assemblies, each texturing bit assembly connected to a drive gear, and driven by a drive motor;

a first telescoping arm and a second telescoping arm configured to support the linear texturing arm, each telescoping arm having an outer sleeve and a piston arm, the piston arm configured to urge the linear texturing arm against the surface to be textured, wherein the first telescoping arm is attached to an outer sleeve of a rotation shaft configured to attach to the carriage rotation device and the second telescoping arm is attached to an inner sleeve of the rotation shaft.

16. The apparatus of claim 1:

wherein the texturing carriage includes a texturing head configured to hold one or more texturing pads and a texturing head motor, the texturing head motor configured to move the one or more texturing pads across a work surface and wherein the texturing carriage is configured to extend and retract the texturing head towards and away from the work surface; and wherein the carriage rotation device coupled to the texturing carriage is configured to selectively rotate the texturing carriage about an arch, optionally wherein the arch is substantially 180 degrees, or wherein the carriage rotation device coupled to the texturing carriage is configured to selectively rotate the texturing carriage about an axis that is substantially parallel to a surface on which the apparatus rests, wherein the work surface is an arcuate or curved work surface, or wherein the work surface is a concave work surface and the apparatus is positioned inside the concavity of the work surface, or wherein the work surface is a semi-spherical work surface and the apparatus is positioned within the semi-spherical work surface, optionally wherein the texturing head includes a plurality of texturing pads and the texturing head motor is coupled to a plurality of gears, each gear coupled to one of the plurality of texturing pads.

17. The apparatus of claim 16, wherein the traversing device is configured to move the apparatus along the surface on which the apparatus rests in a direction substantially perpendicular to the vertical work surface.

18. The apparatus of claim 17, including a horizontal frame member supporting the vertical frame member, the traversing device attached to the horizontal frame member.

19. The apparatus of claim 16, wherein the carriage rotation device is configured to rotate the texturing carriage about an axis substantially perpendicular to a vertical work surface or substantially parallel to the surface on which the apparatus rests, or both.

20. The apparatus of claim 16, wherein the traversing device is configured to move the apparatus along the surface on which the apparatus rests, and wherein the traversing device comprises:

a first drive motor; and a first drive wheel, the first drive wheel configured to move the horizontal base frame member in a first direction, optionally wherein the traversing device comprises:

a second drive motor; and a second drive wheel, the second drive wheel configured to move the horizontal base frame member in a second direction perpendicular to the first direction.

21. The apparatus of claim 20, wherein the apparatus includes a horizontal frame member supporting the vertical frame member, the traversing device attached to the horizontal frame member, and the first drive wheel or the second drive wheel are attached to the horizontal base frame member, and wherein the traversing device comprises:

a wheel rotator, optionally having a lug;

a drive wheel, optionally journaled in a bifurcated bracket comprising an aperture configured to receive the optional lug of the wheel rotator; and a drive motor, optionally journaled in a bifurcated bracket, and configured to drive the drive wheel forming a steerable wheel unit configured to be selectively rotated by the wheel rotator.

22. The apparatus of claim 1, wherein the texturing carriage comprises a texturing head configured to hold one or more texturing pads, and the apparatus includes means for applying a desired pressure of the one or more texturing pads against a work surface, optionally wherein the desired pressure is a desired constant pressure.

23. The apparatus of claim 16, wherein the texturing carriage comprises a texturing head configured to hold one or more texturing pads, and the apparatus includes means for applying a desired pressure of the one or more texturing pads against a work surface, optionally wherein the desired pressure is a desired constant pressure.

24. A method for texturing a surface comprising the steps of:

a) providing the apparatus of claim 1;

b) positioning the frame in relation to a work surface and placing one or more texturing pads in contact with the work surface;

c) using the texturing head motor to move the one or more finishing pads across the work surface; and d) using the vertical frame member or the traversing device, or both, to move the apparatus in a path substantially parallel to the work surface while maintaining the one or more texturing pads in contact with the work surface and while using the motor to move the one or more texturing pads across the work surface.

25. The method of claim 24, including the step of pivoting the texturing head about the texturing carriage, optionally by at least 90 degrees, between a position wherein the texturing pads engage a vertical work surface and wherein the texturing pads engage a horizontal work surface, and/or including the step of selectively rotating the texturing carriage about an arch, optionally wherein the arch is about 180 degrees, and/or including the step of selectively rotating the texturing carriage about an axis that is substantially parallel to a surface on which the apparatus rests, optionally wherein the work surface is an arcuate or curved work surface, and/or wherein the work surface is a concave work surface and the apparatus is positioned inside the concavity of the work surface, and/or wherein the work surface is a semi-spherical work surface and the apparatus is positioned within the semi-spherical work surface.

* * * * *